US012735779B2

(12) United States Patent
Kato et al.

(10) Patent No.: US 12,735,779 B2
(45) Date of Patent: Sep. 15, 2026

(54) MARTENSITIC STAINLESS STEEL SEAMLESS PIPE

(71) Applicant: NIPPON STEEL CORPORATION, Tokyo (JP)

(72) Inventors: Kosei Kato, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 538 days.

(21) Appl. No.: 17/907,308

(22) PCT Filed: Apr. 6, 2021

(86) PCT No.: PCT/JP2021/014594
§ 371 (c)(1),
(2) Date: Sep. 26, 2022

(87) PCT Pub. No.: WO2021/206080
PCT Pub. Date: Oct. 14, 2021

(65) Prior Publication Data

US 2023/0114537 A1 Apr. 13, 2023

(30) Foreign Application Priority Data

Apr. 7, 2020 (JP) ..... 2020-069112
Apr. 7, 2020 (JP) ..... 2020-069137

(51) Int. Cl.
*C22C 38/58* (2006.01)
*C21D 8/10* (2006.01)
(Continued)

(52) U.S. Cl.
CPC ..... *C22C 38/58* (2013.01); *C21D 8/10* (2013.01); *C21D 9/08* (2013.01); *C22C 38/02* (2013.01);
(Continued)

(58) Field of Classification Search
CPC ..... C22C 38/58; C22C 38/02; C22C 38/06; C22C 38/44; C22C 38/46; C21D 8/105; C21D 9/08; C21D 2211/008
See application file for complete search history.

(56) References Cited

U.S. PATENT DOCUMENTS 4,878,955 A * 11/1989 Hoshino ..... C22C 38/001 148/609
5,820,699 A 10/1998 Asahi et al.
(Continued)

FOREIGN PATENT DOCUMENTS

JP 08246107 A 9/1996
JP 10001755 A 1/1998
(Continued)

OTHER PUBLICATIONS

Naoi et al. "Effects of Tungsten on Mechanical Properties and Microstructure in 9Cr-0.5Mo-W Steels." 1990. (Year: 1990).*
(Continued)

*Primary Examiner* — Brian D Walck
(74) *Attorney, Agent, or Firm* — Greer, Burns & Crain, Ltd.

(57) ABSTRACT

The martensitic stainless steel seamless pipe according to the present disclosure has a chemical composition containing, in mass %, C: 0.001 to 0.050%, Si: 0.05 to 1.00%, Mn: 0.05 to 2.00%, P: 0.030% or less, S: 0.0100% or less, Al: 0.005 to 0.100%, N: 0.020% or less, Ni: 1.00 to 9.00%, Cr: 8.00 to 16.00%, Cu: 3.50% or less, Mo: 1.00 to 5.00%, W: 0.01 to 0.30%, V: 0.010 to 1.500%, and Co: 0.001 to 0.500%, and also containing one or more elements selected from the group consisting of Ca, Mg, B, and rare earth metal, with the balance being Fe and impurities, and has a yield strength of 655 MPa or more.

8 Claims, 1 Drawing Sheet

(51) Int. Cl.

| | |
|---|---|
| ***C21D 9/08*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |

(52) U.S. Cl.
CPC ..... *C22C 38/06* (2013.01); *C22C 38/44* (2013.01); *C22C 38/46* (2013.01); *C21D 2211/008* (2013.01)

(56) References Cited

U.S. PATENT DOCUMENTS

| | | | | |
|---|---|---|---|---|
| 11,834,725 | B2 * | 12/2023 | Matsuo | C22C 38/50 |
| 2020/0283866 | A1 * | 9/2020 | Endo | C22C 38/46 |
| 2021/0238705 | A1 | 8/2021 | Matsuo et al. | |
| 2021/0269904 | A1 | 9/2021 | Matsuo et al. | |
| 2023/0114537 | A1 | 4/2023 | Kato et al. | |

FOREIGN PATENT DOCUMENTS

| | | | | | |
|---|---|---|---|---|---|
| JP | 10503809 | A | | 4/1998 | |
| JP | 2000192196 | A | | 7/2000 | |
| JP | 2002167651 | A | * | 6/2002 | |
| JP | 2012136742 | A | | 7/2012 | |
| WO | WO-2019065114 | A1 | * | 4/2019 | C21D 1/22 |
| WO | 2020013197 | A1 | | 1/2020 | |
| WO | 2020067247 | A1 | | 4/2020 | |
| WO | 2021206080 | A1 | | 10/2021 | |

OTHER PUBLICATIONS

ASM Handbook Committee. "Elevated-Temperature Properties of Stainless Steels." ASM Handbook, vol. 1: Properties and Selection: Irons, Steels, and High Performance Alloys. pp. 930-949. 1990. (Year: 1990).*

English language machine translation of JP-2002167651-A. Generated Oct. 17, 2025. (Year: 2025).*

* cited by examiner

MARTENSITIC STAINLESS STEEL SEAMLESS PIPE

TECHNICAL FIELD

The present disclosure relates to a seamless pipe, and more particularly to a martensitic stainless steel seamless pipe having a microstructure mainly composed of martensite.

BACKGROUND ART

In some cases, oil wells or gas wells (hereinafter, oil wells and gas wells are collectively referred to simply as "oil wells") are turned into a corrosive environment containing a corrosive gas. Here, the corrosive gas means carbon dioxide gas and/or hydrogen sulfide gas. That is, steel materials for use in oil wells are required to have excellent corrosion resistance in a corrosive environment.

It is known that chromium (Cr) is effective for improving the corrosion resistance of a steel material in a corrosive environment. Therefore, in corrosive environments, martensitic stainless steel materials containing about 13 mass % of Cr, typified by API L80 13Cr steel material (normal 13Cr steel material) and Super 13Cr steel material in which the C content is reduced, are used.

Japanese Patent Application Publication No. 10-1755 (Patent Literature 1), National Publication of International Patent Application No. 10-503809 (Patent Literature 2), Japanese Patent Application Publication No. 2000-192196 (Patent Literature 3), Japanese Patent Application Publication No. 8-246107 (Patent Literature 4), and Japanese Patent Application Publication No. 2012-136742 (Patent Literature 5) each propose a martensitic stainless steel material that is excellent in corrosion resistance in a corrosive environment.

The steel material disclosed in Patent Literature 1 is a martensitic stainless steel having a chemical composition consisting of, in mass %, C: 0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, and N: 0.005% to 0.1%, with the balance being Fe and impurities, and satisfying $40C+34N+Ni+0.3Cu-1.1Cr-1.8Mo \geq -10$. The microstructure of this steel material consists of tempered martensite, martensite, and retained austenite, and the total fraction of tempered martensite and martensite is 60 to 80%, and the remainder is retained austenite. Patent Literature 1 discloses that this steel material is excellent in corrosion resistance and sulfide stress corrosion cracking resistance.

The steel material disclosed in Patent Literature 2 is a martensitic stainless steel having a chemical composition consisting of, in weight %, C: 0.005 to 0.05%, $Si \leq 0.50\%$, Mn: 0.1 to 1.0%, $P \leq 0.03\%$, $S \leq 0.005\%$, Mo: 1.0 to 3.0%, Cu: 1.0 to 4.0%, Ni: 5 to 8%, and $Al \leq 0.06\%$, with the balance being Fe and impurities, and satisfying $Cr+1.6\,Mo \geq 13$, and $40C+34N+Ni+0.3Cu-1.1Cr-1.8Mo \geq -10.5$. The microstructure of this steel material is a tempered martensite structure. Patent Literature 2 discloses that this steel material is excellent in hot workability and sulfide stress corrosion cracking resistance.

The steel material disclosed in Patent Literature 3 is a martensitic stainless steel having a chemical composition consisting of, in weight %, C: 0.001 to 0.05%, Si: 0.05 to 1%, Mn: 0.05 to 2%, P: 0.025% or less, S: 0.01% or less, Cr: 9 to 14%, Mo: 3.1 to 7%, Ni: 1 to 8%, Co: 0.5 to 7%, sol. Al: 0.001 to 0.1%, N: 0.05% or less, O (oxygen): 0.01% or less, Cu: 0 to 5%, and W: 0 to 5%, with the balance being Fe and impurities. Patent Literature 3 discloses that this steel material is excellent in carbon dioxide gas corrosion resistance and sulfide stress corrosion cracking resistance.

The steel material disclosed in Patent Literature 4 is a martensitic stainless steel having a chemical composition consisting of, in weight %, C: 0.005% to 0.05%, Si: 0.05% to 0.5%, Mn: 0.1% to 1.0%, P: 0.025% or less, S: 0.015% or less, Cr: 12 to 15%, Ni: 4.5% to 9.0%, Cu: 1% to 3%, Mo: 2% to 3%, W: 0.1% to 3%, Al: 0.005 to 0.2%, and N: 0.005% to 0.1%, with the balance being Fe and impurities, and satisfying $40C+34N+Ni+0.3Cu+Co-1.1Cr-1.8Mo-0.9W \geq -10$. Patent Literature 4 discloses that this steel material is excellent in carbon dioxide gas corrosion resistance and sulfide stress corrosion cracking resistance.

The steel material disclosed in Patent Literature 5 is a martensitic stainless steel seamless pipe having a chemical composition consisting of, in mass %, C: 0.01% or less, Si: 0.5% or less, Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%, V: 0.20% or less, Al: 0.05% or less, and N: 0.06% or less, with the balance being Fe and impurities, and which has a yield strength of 655 to 862 MPa and a yield ratio of 0.90 or more. Patent Literature 5 discloses that this steel material is excellent in carbon dioxide gas corrosion resistance and sulfide stress corrosion cracking resistance.

CITATION LIST

Patent Literature

Patent Literature 1: Japanese Patent Application Publication No. 10-1755
Patent Literature 2: National Publication of International Patent Application No. 10-503809
Patent Literature 3: Japanese Patent Application Publication No. 2000-192196
Patent Literature 4: Japanese Patent Application Publication No. 8-246107
Patent Literature 5: Japanese Patent Application Publication No. 2012-136742

SUMMARY OF INVENTION

Technical Problem

In some cases a martensitic stainless steel seamless pipe having excellent corrosion resistance in a corrosive environment is also required to have a yield strength of 655 MPa or more (95 ksi or more). Therefore, a martensitic stainless steel seamless pipe which has a yield strength of 655 MPa or more and is excellent in corrosion resistance may be obtained by a technique other than the techniques disclosed in the aforementioned Patent Literatures 1 to 5.

A martensitic stainless steel seamless pipe is also sometimes subjected to hot rolling that is typified by piercing-rolling during production. In piercing-rolling, a hollow shell is produced from a solid-core starting material. Here, a flaw is liable to be formed on the inner surface of a hollow shell produced by piercing-rolling. In the present description, a flaw that is formed on the inner surface of a hollow shell is also referred to as an "inner surface flaw". If an inner surface flaw is formed on a hollow shell formed by piercing-rolling, the inner surface flaw will also remain on the inner surface of the martensitic stainless steel seamless pipe that is produced. If an inner surface flaw is formed deeply on a martensitic stainless steel seamless pipe, in some cases the desired mechanical properties will not be obtained in the seamless pipe. For this reason, an inner surface flaw which has been formed deeply on the inner surface of a seamless pipe is removed by machining such as grinding. On the other hand, in a case where an inner surface flaw on a seamless pipe is removed by grinding or the like, depending on the depth of the inner surface flaw, the wall thickness of the seamless pipe may become thinner than the desired wall thickness. Thus, it is preferable that formation of an inner surface flaw can be suppressed on a martensitic stainless steel seamless pipe.

As described above, it is preferable that a martensitic stainless steel seamless pipe has a yield strength of 655 MPa or more and excellent corrosion resistance, and furthermore, that formation of an inner surface flaw on the martensitic stainless steel seamless pipe can be suppressed. However, in the aforementioned Patent Literatures 1 to 5, there are no discussions regarding an inner surface flaw formed by piercing-rolling.

An objective of the present disclosure is to provide a martensitic stainless steel seamless pipe having a yield strength of 655 MPa or more and excellent corrosion resistance, and in which the formation of an inner surface flaw has been suppressed.

Solution to Problem

A martensitic stainless steel seamless pipe according to the present disclosure consists of, in mass %, C: 0.001 to 0.050%,
Si: 0.05 to 1.00%,
Mn: 0.05 to 2.00%,
P: 0.030% or less,
S: 0.0100% or less,
Al: 0.005 to 0.100%,
N: 0.020% or less,
Ni: 1.00 to 9.00%,
Cr: 8.00 to 16.00%,
Cu: 3.50% or less,
Mo: 1.00 to 5.00%,
W: 0.01 to 0.30%,
V: 0.010 to 1.500%,
Co: 0.001 to 0.500%,
Ca: 0 to 0.0250%,
Mg: 0 to 0.0250%,
B: 0 to 0.0200%,
rare earth metal: 0 to 0.200%,
Nb: 0 to 0.100%,
Ta: 0 to 0.100%,
Ti: 0 to 0.100%,
Zr: 0 to 0.100%,
Hf: 0 to 0.100%,
Sn: 0 to 0.100%, and
the balance: Fe and impurities,
wherein:
within ranges of contents of elements of the martensitic stainless steel seamless pipe, the contents of elements satisfy Formula (1), and
a yield strength is 655 MPa or more:

$$10Ca+10Mg+2B+REM \geq 0.0010 \quad (1)$$

where, a content in mass % of a corresponding element is substituted for Ca, Mg, and B in Formula (1), and a total content in mass % of rare earth metal is substituted for REM in Formula (1).

Advantageous Effects of Invention

The martensitic stainless steel seamless pipe according to the present disclosure has a yield strength of 655 MPa or more and excellent corrosion resistance, and furthermore, the formation of an inner surface flaw on the martensitic stainless steel seamless pipe is suppressed.

DESCRIPTION OF EMBODIMENT

Figure 1:
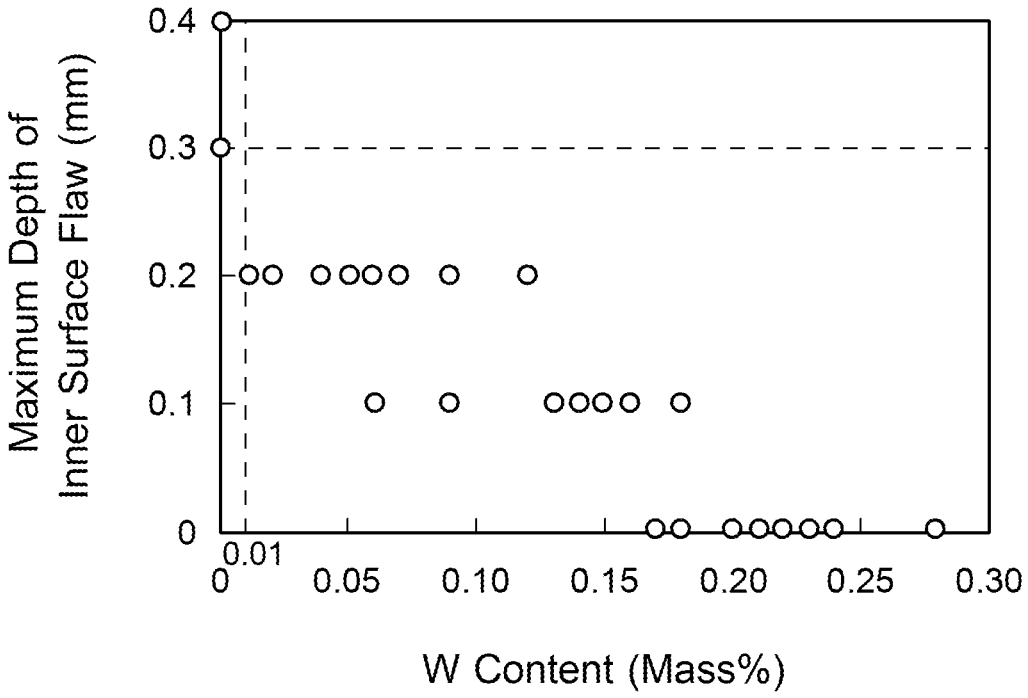
FIG. 1 is a diagram illustrating the relation between a W content (mass %) and a maximum depth (mm) of an inner surface flaw in the present Examples.

The present inventors conducted investigations and studies with respect to a martensitic stainless steel seamless pipe having a yield strength of 655 MPa or more and excellent corrosion resistance, and in which formation of an inner surface flaw has been suppressed. As a result, the present inventors obtained the following findings.

First, the present inventors conducted a detailed study regarding elements that increase the corrosion resistance of a steel material. As a result, the present inventors found that if Cr, Mo, Cu, Ni, and Co are appropriately contained in a steel material, the corrosion resistance of the steel material will be increased. That is, the present inventors considered that when a martensitic stainless steel seamless pipe has a chemical composition containing in mass %, C: 0.001 to 0.050%, Si: 0.05 to 1.00%, Mn: 0.05 to 2.00%, P: 0.030% or less, S: 0.0100% or less, Al: 0.005 to 0.100%, N: 0.020% or less, Ni: 1.00 to 9.00%, Cr: 8.00 to 16.00%, Cu: 3.50% or less, Mo: 1.00 to 5.00%, V: 0.010 to 1.500%, Co: 0.001 to 0.500%, Nb: 0 to 0.100%, Ta: 0 to 0.100%, Ti: 0 to 0.100%, Zr: 0 to 0.100%, Hf: 0 to 0.100%, and Sn: 0 to 0.100%, there is a possibility that both a yield strength of 655 MPa or more and excellent corrosion resistance can be compatibly obtained.

On the other hand, in the case of a martensitic stainless steel seamless pipe having the aforementioned chemical composition, an inner surface flaw may sometimes be formed during piercing-rolling in the production process. If an inner surface flaw is formed on a hollow shell due to piercing-rolling, it is necessary to perform an operation to remove the inner surface flaw by grinding or the like. In such case, the productivity with respect to the seamless pipe will decrease. In addition, if an inner surface flaw is formed too deeply by piercing-rolling, it is necessary to grind the inner surface of the hollow shell to a deep part to remove the inner surface flaw. Consequently, in some cases the wall thickness of a produced seamless pipe will be thin.

Therefore, the present inventors conducted a study regarding a method for suppressing the occurrence of an inner surface flaw on a martensitic stainless steel seamless pipe having the aforementioned chemical composition. As a result, in addition to the aforementioned chemical composition, as elements that improve hot workability, the present inventors focused on calcium (Ca), magnesium (Mg), boron (B), and rare earth metal (REM). Ca, Mg, and REM immobilize sulfur (S) in the steel material as a sulfide to make it harmless, and thereby improve the hot workability of the steel material. B suppresses segregation of sulfur in the steel material at grain boundaries, and thereby improves the hot workability of the steel material. That is, the present inventors considered that if Ca, Mg, B, and/or REM are contained, it is likely that the occurrence of an inner surface flaw can be suppressed.

Here, F1 is defined as F=10Ca+10 Mg+2B+REM. If F1 is increased, a decrease in the hot workability of the steel material caused by S can be suppressed, and the formation of an inner surface flaw on the steel material can be suppressed. Therefore, in addition to the contents of elements described above, the martensitic stainless steel seamless pipe according to the present embodiment also contains Ca in an amount of 0 to 0.0250%, Mg in an amount of 0 to 0.0250%, B in an amount of 0 to 0.0200%, and REM in an amount of 0 to 0.200%, and furthermore, the contents of these elements satisfy Formula (1):

$$10Ca+10Mg+2B+REM \geq 0.0010 \quad (1)$$

where, the content in mass % of the corresponding element is substituted for Ca, Mg, and B in Formula (1). The total content in mass % of rare earth metal is substituted for REM in Formula (1).

On the other hand, even in the case of a martensitic stainless steel seamless pipe containing, in mass %, C: 0.001 to 0.050%, Si: 0.05 to 1.00%, Mn: 0.05 to 2.00%, P: 0.030% or less, S: 0.0100% or less, Al: 0.005 to 0.100%, N: 0.020% or less, Ni: 1.00 to 9.00%, Cr: 8.00 to 16.00%, Cu: 3.50% or less, Mo: 1.00 to 5.00%, V: 0.010 to 1.500%, Co: 0.001 to 0.500%, Ca: 0 to 0.0250%, Mg: 0 to 0.0250%, B: 0 to 0.0200%, REM: 0 to 0.200%, Nb: 0 to 0.100%, Ta: 0 to 0.100%, Ti: 0 to 0.100%, Zr: 0 to 0.100%, Hf: 0 to 0.100%, and Sn: 0 to 0.100%, and also satisfying Formula (1), in some cases an inner surface flaw was deeply formed on the martensitic stainless steel seamless pipe. Therefore, the present inventors conducted studies with respect to a method for further suppressing formation of an inner surface flaw on a martensitic stainless steel seamless pipe having the contents of elements described above. As a result, the present inventors discovered that when tungsten (W) is further contained in addition to the contents of elements described above, the formation of an inner surface flaw on a seamless pipe can be suppressed. This point is described specifically hereunder using the drawings.

FIG. 1 is a diagram illustrating the relation between a W content (mass %) and a maximum depth (mm) of an inner surface flaw in the present Examples. FIG. 1 was created using, from among Examples to be described later, a W content (mass %) and a maximum depth (mm) of an inner surface flaw caused by piercing-rolling with respect to steel materials having the contents of elements described above and satisfying Formula (1) and which exhibited excellent corrosion resistance. Note that, the maximum depth (mm) of an inner surface flaw was obtained by a method to be described later. Further, the yield strength of each steel material used in FIG. 1 was 655 MPa or more.

Referring to FIG. 1, in a steel material having the contents of elements described above and satisfying Formula (1) and which exhibits excellent corrosion resistance, when W is contained in an amount of 0.01%, the maximum depth of an inner surface flaw will be less than 0.3 mm. That is, the fact that formation of an inner surface flaw can be suppressed when the W content is 0.01% or more is proven by FIG. 1.

The reason why the formation of an inner surface flaw can be suppressed by containing W in an amount of 0.01% or more has not been clarified in detail. However, the present inventors infer as follows. In a case where a steel material having the contents of elements described above and satisfying Formula (1) is subjected to piercing-rolling, oxides form on the surface of the steel material during heating before piercing-rolling and during piercing-rolling. There is a possibility that W dissolves in the oxides and lowers the melting point of the oxides. In this case, there is a possibility that the oxides may melt and liquefy during piercing-rolling. It is surmised that, as a result, the oxides in which W dissolved function as a lubricant, and even if piercing-rolling is performed, these oxides can suppress formation of an inner surface flaw.

Note that, the effect that formation of an inner surface flaw on a steel material can be suppressed by the W content being 0.01% or more is proven by Examples that are described later. That is, even when W has suppressed the formation of an inner surface flaw on a steel material by a mechanism that is different to the above mechanism considered by the present inventors, the fact that W can suppress the formation of an inner surface flaw on a martensitic stainless steel seamless pipe having the chemical composition described above is proven by the Examples.

Accordingly, in addition to having the contents of elements described above and satisfying Formula (1), the martensitic stainless steel seamless pipe according to the present embodiment also contains W in an amount of 0.01 to 0.30%. As a result, the martensitic stainless steel seamless pipe according to the present embodiment not only has a yield strength of 655 MPa or more and excellent corrosion resistance, but furthermore the formation of an inner surface flaw is also suppressed on the martensitic stainless steel seamless pipe.

The gist of the martensitic stainless steel seamless pipe according to the present embodiment which has been completed based on the above findings is as follows.

[1]

A martensitic stainless steel seamless pipe, consisting of, in mass %,

C: 0.001 to 0.050%,
Si: 0.05 to 1.00%,
Mn: 0.05 to 2.00%,
P: 0.030% or less,
S: 0.0100% or less,
Al: 0.005 to 0.100%,
N: 0.020% or less,
Ni: 1.00 to 9.00%,
Cr: 8.00 to 16.00%,
Cu: 3.50% or less,
Mo: 1.00 to 5.00%,
W: 0.01 to 0.30%,
V: 0.010 to 1.500%,
Co: 0.001 to 0.500%,
Ca: 0 to 0.0250%,
Mg: 0 to 0.0250%,
B: 0 to 0.0200%,
rare earth metal: 0 to 0.200%,
Nb: 0 to 0.100%,
Ta: 0 to 0.100%,
Ti: 0 to 0.100%,
Zr: 0 to 0.100%,
Hf: 0 to 0.100%,
Sn: 0 to 0.100%, and
the balance: Fe and impurities,
wherein:
within ranges of contents of elements of the martensitic stainless steel seamless pipe, the contents of elements satisfy Formula (1), and
a yield strength is 655 MPa or more:

$$10Ca+10Mg+2B+REM \geq 0.0010 \quad (1)$$

where, a content in mass % of a corresponding element is substituted for Ca, Mg, and B in Formula (1), and a total content in mass % of rare earth metal is substituted for REM in Formula (1).

[2]

The martensitic stainless steel seamless pipe according to [1], containing one or more elements selected from the group consisting of:

Nb: 0.001 to 0.100%,

Ta: 0.001 to 0.100%,

Ti: 0.001 to 0.100%,

Zr: 0.001 to 0.100%,

Hf: 0.001 to 0.100%, and

Sn: 0.001 to 0.100%.

[3]

The martensitic stainless steel seamless pipe according to [1] or [2], containing:

W: 0.01 to 0.25%.

[4]

The martensitic stainless steel seamless pipe according to any one of [1] to [3], wherein within the ranges of contents of elements of the martensitic stainless steel seamless pipe, the contents of elements satisfy Formula (2), $$0.05Mo+W \geq \alpha \quad (2)$$

where, $\alpha$ in Formula (2) is 0.240 in a case where, among the elements of the martensitic stainless steel seamless pipe, a Cu content is less than 0.50%, and is 0.200 in a case where the Cu content is 0.50 to 3.50%; and a content in mass % of a corresponding element is substituted for W and Mo in Formula (2).

[5]

The martensitic stainless steel seamless pipe according to any one of [1] to [4], wherein:

the martensitic stainless steel seamless pipe is a seamless pipe for oil wells.

In the present description, the term "seamless pipe for oil wells" means a generic term of a casing pipe, a tubing pipe, and a drilling pipe, which are used for drilling of an oil well or a gas well, collection of crude oil or natural gas, and the like.

The martensitic stainless steel seamless pipe according to the present embodiment will be described in detail below. The sign "%" following each element means mass percent unless otherwise noted.

[Chemical Composition]

The martensitic stainless steel seamless pipe according to the present embodiment has a chemical composition containing the following elements.

C: 0.001 to 0.050%

Carbon (C) improves hardenability of steel material, thus increasing the strength of the steel material. If the C content is too low, this effect cannot be sufficiently obtained even if the contents of other elements are within the range of the present embodiment. On the other hand, if the C content is too high, the corrosion resistance of the steel material will deteriorate even if the contents of other elements are within the range of the present embodiment. Therefore, the C content is 0.001 to 0.050%. A lower limit of the C content is preferably 0.002%, more preferably 0.003%, and further preferably 0.005%. An upper limit of the C content is preferably 0.045%, and more preferably 0.040%.

Si: 0.05 to 1.00%

Silicon (Si) deoxidizes steel. If the Si content is too low, this effect cannot be sufficiently obtained even if the contents of other elements are within the range of the present embodiment. On the other hand, if the Si content is too high, this effect will be saturated even if the contents of other elements are within the range of the present embodiment. Therefore, the Si content is 0.05 to 1.00%. A lower limit of the Si content is preferably 0.07%, more preferably 0.10%, and further preferably 0.15%. An upper limit of the Si content is preferably 0.70%, more preferably 0.65%, and further preferably 0.60%.

Mn: 0.05 to 2.00%

Manganese (Mn) improves hardenability of steel and increases the strength of the steel material. If the Mn content is too low, this effect cannot be sufficiently obtained even if the contents of other elements are within the range of the present embodiment. On the other hand, in some cases Mn may segregate at grain boundaries together with impurity elements such as P and S. Therefore, if the Mn content is too high, the corrosion resistance of the steel material will deteriorate even if the contents of other elements are within the range of the present embodiment. Therefore, the Mn content is 0.05 to 2.00%. A lower limit of the Mn content is preferably 0.15%, more preferably 0.18%, further preferably 0.20%, further preferably 0.30%, and further preferably 0.50%. An upper limit of the Mn content is preferably 1.90%, more preferably 1.85%, and further preferably 1.80%.

P: 0.030% or Less

Phosphorus (P) is an impurity which is unavoidably contained. That is, a lower limit of the P content is more than 0%. P segregates at crystal grain boundaries and thereby reduces the corrosion resistance of the steel. Therefore, the P content is 0.030% or less. An upper limit of the P content is preferably 0.028%, and more preferably 0.025%. The P content is preferably as low as possible. However, extremely reducing the P content will result in a significant increase in the production cost. Therefore, considering industrial production, a lower limit of the P content is preferably 0.001%, more preferably 0.002%, and further preferably 0.005%.

S: 0.0100% or Less

Sulfur (S) is an impurity which is unavoidably contained. That is, a lower limit of the S content is more than 0%. S segregates at crystal grain boundaries and thereby reduces toughness and the hot workability of the steel material. S also combines with Mn to form MnS, which is an inclusion, thus causing toughness and the hot workability of the steel material to deteriorate. Therefore, the S content is 0.0100% or less. An upper limit of the S content is preferably 0.0095%, more preferably 0.0090%, and further preferably 0.0080%. The S content is preferably as low as possible. However, extremely reducing the S content will result in a significant increase in the production cost. Therefore, considering industrial production, a lower limit of the S content is preferably 0.0001%, more preferably 0.0002%, and further preferably 0.0005%.

Al: 0.005 to 0.100%

Aluminum (Al) deoxidizes steel. If the Al content is too low, this effect cannot be sufficiently obtained even if the contents of other elements are within the range of the present embodiment. On the other hand, if the Al content is too high, even if the contents of other elements are within the range of the present embodiment, this effect will be saturated. Therefore, the Al content is 0.005 to 0.100%. A lower limit of the Al content is preferably 0.008%, more preferably 0.010%, further preferably 0.015%, further preferably 0.020%, and further preferably 0.025%. An upper limit of the Al content is preferably 0.090%, more preferably 0.080%, and further preferably 0.070%. Note that the term "Al content" as used in the present description means the content of sol. Al (acid soluble Al).

N: 0.020% or Less

Nitrogen (N) is unavoidably contained. That is, a lower limit of the N content is more than 0%. N combines with Ti to form Ti nitrides. Fine Ti nitrides suppress coarsening of grains by the pinning effect. On the other hand, if the N content is too high, even if the contents of other elements are within the range of the present embodiment, coarse nitrides will form and toughness of the steel material will decrease. Therefore, the N content is 0.020% or less. An upper limit of the N content is preferably 0.018%, more preferably 0.015%, and further preferably 0.012%. A lower limit of the N content is preferably 0.001%, more preferably 0.002%, and further preferably 0.003%. A preferable lower limit of the N content for more effectively obtaining the above effect is 0.004%, and more preferably 0.005%.

Ni: 1.00 to 9.00%

Nickel (Ni) is an austenite forming element, and causes the microstructure after quenching to become martensitic. Ni also increases the corrosion resistance of the steel material. If the Ni content is too low, even if the contents of other elements are within the range of the present embodiment, in some cases a large amount of ferrite may be included in the microstructure after tempering. In such a case, desired mechanical properties of the steel material cannot be obtained. In addition, if the Ni content is too low, even if the contents of other elements are within the range of the present embodiment, sufficient corrosion resistance of the steel material cannot be obtained. On the other hand, if the Ni content is too high, the $A_{c1}$ transformation point will become too low, thus making it difficult to perform thermal refining on the steel material even if the contents of other elements are within the range of the present embodiment. As a result, desired mechanical properties of steel material may not be obtained. Therefore, the Ni content is 1.00 to 9.00%. A lower limit of the Ni content is preferably 1.50%, more preferably 2.00%, further preferably 2.50%, further preferably 3.00%, and further preferably 3.50%. An upper limit of the Ni content is preferably 8.50%, more preferably 8.00%, and further preferably 7.50%.

Cr: 8.00 to 16.00%

Chromium (Cr) forms a film on the surface of the steel material, thereby increasing the corrosion resistance of the steel material. If the Cr content is too low, this effect cannot be sufficiently obtained even if the contents of other elements are within the range of the present embodiment. On the other hand, if the Cr content is too high, even if the contents of other elements are within the range of the present embodiment, intermetallic compounds and Cr oxides will excessively form, and coarse intermetallic compounds and/or coarse Cr oxides will form, and consequently the SSC resistance of the steel material will decrease. Therefore, the Cr content is 8.00 to 16.00%. A lower limit of the Cr content is preferably 8.50%, more preferably 9.00%, further preferably 10.00%, further preferably 10.50%, further preferably 10.65%, further preferably 10.70%, further preferably 10.80%, and further preferably 11.00%. An upper limit of the Cr content is preferably 15.50%, more preferably 15.00%, further preferably 14.50%, and further preferably 14.20%.

Cu: 3.50% or Less

Copper (Cu) is unavoidably contained. That is, a lower limit of the Cu content is more than 0%. Cu dissolves in the steel material and thereby improves the corrosion resistance of the steel material. On the other hand, if the Cu content is too high, the hot workability of the steel material will deteriorate even if the contents of other elements are within the range of the present embodiment. Therefore, the Cu content is 3.50% or less. A lower limit of the Cu content is preferably 0.01%, more preferably 0.02%, and further preferably 0.03%. Here, if the Cu content is 0.50% or more, the corrosion resistance of the steel material further improves. In addition, if the Cu content is 0.50% or more, the Cu also assists the effect of Formula (2) that is described later. Specifically, if the Cu content is 0.50% or more, even when 0.05Mo+W defined as F2 is a little low, an inner surface flaw can be further suppressed. A lower limit of the Cu content for effectively obtaining these effects is preferably 0.50%, more preferably 0.60%, further preferably 0.80%, and further preferably 1.00%. An upper limit of the Cu content is preferably 3.30%, more preferably 3.10%, and further preferably 2.90%. On the other hand, if the Cu content is less than 0.50%, the production costs can be lowered. Therefore, in a case where the Cu content is less than 0.50%, an upper limit of the Cu content is preferably 0.48%, more preferably 0.45%, and further preferably 0.43%.

Mo: 1.00 to 5.00%

Molybdenum (Mo) increases the strength of the steel material. Mo also increases the corrosion resistance of the steel material. In addition, Mo assists W that suppresses the formation of an inner surface flaw on the steel material. If the Mo content is too low, these effects cannot be sufficiently obtained even if the contents of other elements are within the range of the present embodiment. On the other hand, Mo is a ferrite forming element. Therefore, if the Mo content is too high, even if the contents of other elements are within the range of the present embodiment, it will become difficult for austenite to stabilize, and it will be difficult for a microstructure mainly composed of martensite to be stably obtained. Consequently, in some cases the desired mechanical properties will not be obtained in the steel material. Therefore, the Mo content is 1.00 to 5.00%. A lower limit of the Mo content is preferably 1.10%, more preferably 1.20%, further preferably 1.50%, and further preferably 1.80%. An upper limit of the Mo content is preferably 4.70%, more preferably 4.50%, further preferably 4.00%, and further preferably 3.80%.

W: 0.01 to 0.30%

Tungsten (W) suppresses the formation of an inner surface flaw. If the W content is too low, this effect cannot be sufficiently obtained even if the contents of other elements are within the range of the present embodiment. Therefore, the W content is 0.01 to 0.30%. On the other hand, if the W content is too high, even if the contents of other elements are within the range of the present embodiment, in some cases the strength of the steel material will become too high. In such a case, the stress necessary for piercing-rolling will become too high. This point will now be described specifically using the drawings.

Figure 2:
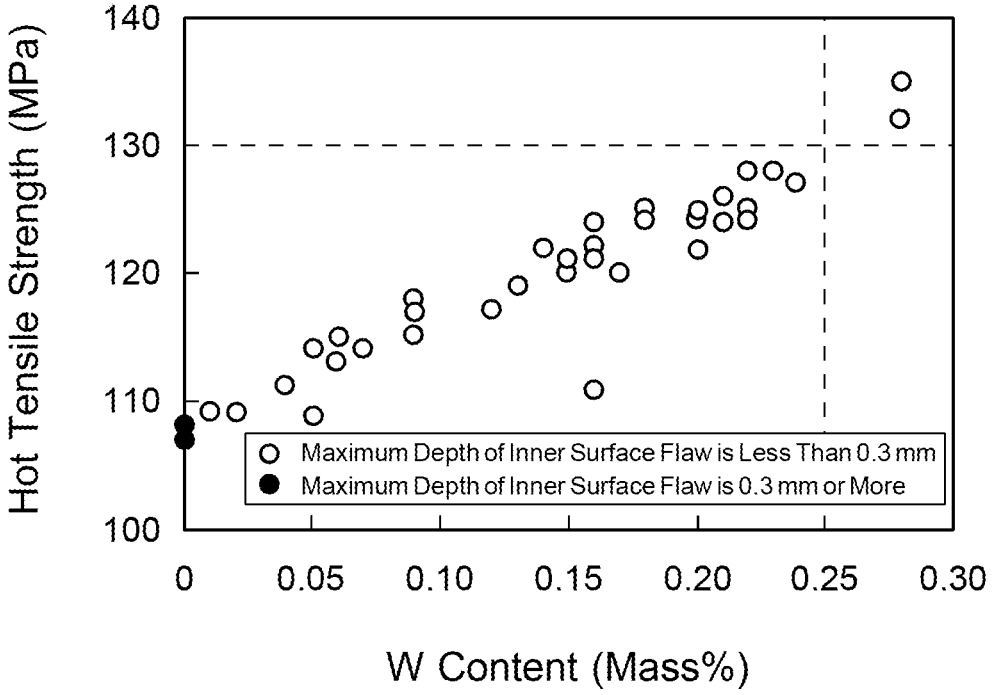
FIG. 2 is a diagram illustrating the relation between a W content (mass %) and a hot tensile strength (MPa) that is an index of a load applied to a piercing-rolling mill in the present Examples.

FIG. 2 is a diagram illustrating the relation between a W content (mass %) and hot tensile strength (MPa) in the present Examples. FIG. 2 was created using W contents (mass %) and hot tensile strengths (MPa) with respect to, among Examples that are described later, steel materials in which the contents of elements other than W satisfied the ranges described in the present embodiment. Note that, a preferable production method that is described later was used for the piercing-rolling. Further, in a hot workability test (Gleeble test) conducted under conditions to be described later, a maximum stress until the steel material broke was defined as "hot tensile strength". Note that, the symbol "○" in FIG. 2 indicates a steel material in which the maximum depth of an inner surface flaw formed by piercing-rolling was less than 0.3 mm. On the other hand, the symbol "●" in FIG. 2 indicates a steel material in which the maximum depth of an inner surface flaw formed by piercing-rolling was 0.3 mm or more.

Referring to FIG. 2, in a steel material satisfying the chemical composition according to the present embodiment, when the W content is more than 0.25%, the hot tensile strength is more than 130 MPa. In this case, a load applied to the piercing-rolling mill is large. Therefore, in the chemical composition of the martensitic stainless steel seamless pipe according to the present embodiment, it is preferable to set the W content to 0.25% or less. In addition, as mentioned above, if the W content is less than 0.01%, the maximum depth of an inner surface flaw will be 0.3 mm or more. Accordingly, the W content according to the present embodiment is preferably 0.01 to 0.25%. In such case, formation of an inner surface flaw on the seamless pipe can be suppressed and, furthermore, a load applied to the piercing-rolling mill can be reduced.

A lower limit of the W content is preferably 0.02%, more preferably 0.04%, further preferably 0.05%, further preferably 0.06%, and further preferably 0.07%. An upper limit of the W content is preferably 0.24%, more preferably is less than 0.24%, further preferably is 0.23%, and further preferably is 0.22%.

V: 0.010 to 1.500%

Vanadium (V) improves hardenability of the steel material and increases the strength of the steel material. If the V content is too low, this effect cannot be sufficiently obtained even if the contents of other elements are within the range of the present embodiment. On the other hand, if the V content is too high, even if the contents of other elements are within the range of the present embodiment, toughness of the steel material will decrease. Therefore, the V content is 0.010 to 1.500%. A lower limit of the V content is preferably 0.020%, more preferably 0.030%, and further preferably 0.040%. An upper limit of the V content is preferably 1.000%, more preferably 0.700%, further preferably 0.500%, and further preferably 0.300%.

Co: 0.001 to 0.500%

Cobalt (Co) improves the corrosion resistance of the steel material. Co also improves hardenability of the steel material and stabilizes the steel material strength. If the Co content is too low these effects cannot be sufficiently obtained even if the contents of other elements are within the range of the present embodiment. On the other hand, if the Co content is too high, toughness of the steel material will decrease even if the contents of other elements are within the range of the present embodiment. Accordingly, the Co content is 0.001 to 0.500%. A lower limit of the Co content is preferably 0.005%, more preferably 0.010%, further preferably 0.030%, further preferably 0.050%, further preferably 0.100%, further preferably 0.120%, and further preferably 0.150%. An upper limit of the Co content is preferably 0.450%, more preferably 0.400%, and further preferably 0.350%.

The balance of the martensitic stainless steel seamless pipe according to the present embodiment is Fe and impurities. Here, the term "impurities" refers to elements which, during industrial production of the steel material, are mixed-in from ores and scrap as the raw material, or from the production environment or the like, and which are not intentionally contained, but are allowed within a range not adversely affecting the martensitic stainless steel seamless pipe according to the present embodiment.

[Optional Elements]

[First Group of Optional Elements]

The chemical composition of the martensitic stainless steel seamless pipe according to the present embodiment further contains one or more types of elements selected from the group consisting of Ca, Mg, B and rare earth metal (REM). Each of these elements improves the hot workability of the steel material, and suppresses the formation of an inner surface flaw on the steel material.

Ca: 0 to 0.0250%

Calcium (Ca) is an optional element and does not have to be contained. That is, the Ca content may be 0%. When contained, Ca immobilizes S in the steel material as a sulfide to make it harmless. As a result, the hot workability of the steel material improves. When Ca is contained even in a small amount, this effect will be obtained to some extent. On the other hand, if the Ca content is too high, even if the contents of other elements are within the range of the present embodiment, inclusions in the steel material will coarsen and toughness of the steel material will decrease. Therefore, the Ca content is 0 to 0.0250%. A lower limit of the Ca content for effectively obtaining the aforementioned effect is preferably 0.0001%, more preferably 0.0005%, further preferably 0.0010%, and further preferably 0.0020%. An upper limit of the Ca content is preferably 0.0200%, more preferably 0.0150%, and further preferably 0.0100%.

Mg: 0 to 0.0250%

Magnesium (Mg) is an optional element and does not have to be contained. That is, the Mg content may be 0%. When contained, Mg immobilizes S in the steel material as a sulfide to make it harmless. As a result, the hot workability of the steel material improves. When Mg is contained even in a small amount, the aforementioned effect will be obtained to some extent. On the other hand, if the Mg content is too high, even if the contents of other elements are within the range of the present embodiment, inclusions in the steel material will coarsen and toughness of steel material will decrease. Therefore, the Mg content is 0 to 0.0250%. A lower limit of the Mg content for effectively obtaining the aforementioned effect is preferably 0.0001%, more preferably 0.0005%, further preferably 0.0010%, and further preferably 0.0020%. An upper limit of the Mg content is preferably 0.0240%, more preferably 0.0220%, and further preferably 0.0200%.

B: 0 to 0.0200%

Boron (B) is an optional element and does not have to be contained. That is, the B content may be 0%. When contained, B suppresses segregation of S in the steel material at crystal grain boundaries. As a result, the hot workability of the steel material improves. When B is contained even in a small amount, the aforementioned effect will be obtained to some extent. On the other hand, if the B content is too high, boron nitride (BN) will be produced, thereby decreasing toughness of the steel material even if the contents of other elements are within the range of the present embodiment. Therefore, the B content is 0 to 0.0200%. A lower limit of the B content for effectively obtaining the aforementioned effect is preferably 0.0005%, more preferably 0.0010%, further preferably 0.0012%, and further preferably 0.0014%. An upper limit of the B content is preferably 0.0180%, more preferably 0.0170%, and further preferably 0.0150%.

Rare Earth Metal: 0 to 0.200%

Rare earth metal (REM) is an optional element and does not have to be contained. That is, the REM content may be 0%. When contained, REM immobilizes S in the steel material as a sulfide to make it harmless. As a result, the hot workability of the steel material improves. When REM is contained even in a small amount, the aforementioned effect will be obtained to some extent. On the other hand, if the REM content is too high, even if the contents of other elements are within the range of the present embodiment, inclusions in the steel material will coarsen and toughness of the steel material will decrease. Therefore, the REM content is 0 to 0.200%. A lower limit of the REM content for effectively obtaining the aforementioned effect is preferably 0.001%, more preferably 0.010%, further preferably 0.020%, and further preferably 0.025%. An upper limit of the REM content is preferably 0.190%, more preferably 0.180%, and further preferably 0.170%.

Note that, in the present description the term "REM" means one or more types of elements selected from the group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. In the present description the term "REM content" refers to the total content of these elements.

[Second Group of Optional Elements]

The chemical composition of the martensitic stainless steel seamless pipe according to the present embodiment may further contain one or more elements selected from the group consisting of Nb, Ta, Ti, Zr and Hf in lieu of part of Fe. Each of these elements is an optional element, and increases the strength of the steel material.

Nb: 0 to 0.100%

Niobium (Nb) is an optional element and does not have to be contained. That is, the Nb content may be 0%. When contained, Nb forms carbo-nitrides and increases the strength of the steel material. When Nb is contained even in a small amount, this effect will be obtained to some extent. On the other hand, if the Nb content is too high, even if the contents of other elements are within the range of the present embodiment, the strength of the steel material will become too high and toughness of the steel material will decrease. Therefore, the Nb content is 0 to 0.100%. A lower limit of the Nb content is preferably more than 0%, more preferably 0.001%, and further preferably 0.002%. An upper limit of the Nb content is preferably 0.090%, and more preferably 0.080%.

Ta: 0 to 0.100%

Tantalum (Ta) is an optional element and does not have to be contained. That is, the Ta content may be 0%. When contained, Ta forms carbo-nitrides and increases the strength of the steel material. When Ta is contained even in a small amount, this effect will be obtained to some extent. On the other hand, if the Ta content is too high, even if the contents of other elements are within the range of the present embodiment, the strength of the steel material will become too high and toughness of the steel material will decrease. Therefore, the Ta content is 0 to 0.100%. A lower limit of the Ta content is preferably more than 0%, more preferably 0.001%, further preferably 0.002%, and further preferably 0.003%. An upper limit of the Ta content is preferably 0.090%, and more preferably 0.080%.

Ti: 0 to 0.100%

Titanium (Ti) is an optional element and does not have to be contained. That is, the Ti content may be 0%. When contained, Ti forms carbo-nitrides and increases the strength of the steel material. When Ti is contained even in a small amount, this effect will be obtained to some extent. On the other hand, if the Ti content is too high, even if the contents of other elements are within the range of the present embodiment, the strength of the steel material will become too high and toughness of the steel material will decrease. Therefore, the Ti content is 0 to 0.100%. A lower limit of the Ti content is preferably more than 0%, more preferably 0.001%, and further preferably 0.002%. An upper limit of the Ti content is preferably 0.090%, and more preferably 0.080%.

Zr: 0 to 0.100%

Zirconium (Zr) is an optional element and does not have to be contained. That is, the Zr content may be 0%. When contained, Zr forms carbo-nitrides and increases the strength of the steel material. When Zr is contained even in a small amount, this effect will be obtained to some extent. On the other hand, if the Zr content is too high, even if the contents of other elements are within the range of the present embodiment, the strength of the steel material will become too high and toughness of the steel material will decrease. Therefore, the Zr content is 0 to 0.100%. A lower limit of the Zr content is preferably more than 0%, more preferably 0.001%, further preferably 0.002%, and further preferably 0.003%. An upper limit of the Zr content is preferably 0.090%, and further preferably 0.080%.

Hf: 0 to 0.100%

Hafnium (HO is an optional element and does not have to be contained. That is, the Hf content may be 0%. When contained, Hf forms carbo-nitrides and increases the strength of the steel material. When Hf is contained even in a small amount, this effect will be obtained to some extent. On the other hand, if the Hf content is too high, even if the contents of other elements are within the range of the present embodiment, the strength of the steel material will become too high and toughness of the steel material will decrease. Therefore, the Hf content is 0 to 0.100%. A lower limit of the Hf content is preferably more than 0%, more preferably 0.001%, and further preferably 0.002%. An upper limit of the Hf content is preferably 0.090%, and more preferably 0.080%.

[Third Group of Optional Elements]

The chemical composition of the martensitic stainless steel seamless pipe according to the present embodiment may further contain Sn in lieu of part of Fe.

Sn: 0 to 0.100%

Tin (Sn) is an optional element and does not have to be contained. That is, the Sn content may be 0%. When contained, Sn increases the corrosion resistance of the steel material. When Sn is contained even in a small amount, this effect will be obtained to some extent. On the other hand, if the Sn content is too high, even if the contents of other elements are within the range of the present embodiment, liquation embrittlement cracking may occur at grain boundaries during hot working. Therefore, the Sn content is 0 to 0.100%. A lower limit of the Sn content is preferably more than 0%, more preferably 0.001%, and further preferably 0.002%. An upper limit of the Sn content is preferably 0.090%, and more preferably 0.080%.

[Regarding Formula (I)]

In the martensitic stainless steel seamless pipe according to the present embodiment, within the ranges of the contents of elements described above, the contents of elements satisfy Formula (1):

$$10Ca+10Mg+2+REM \geq 0.0010 \quad (1)$$

where, the content in mass % of the corresponding element is substituted for Ca, Mg, and B in Formula (1). The total content in mass % of rare earth metal is substituted for REM in Formula (1). Note that, in a case where Ca, Mg, or B is not contained, "0" is substituted for the symbol of the corresponding element. If rare earth metal is not contained, "0" is substituted for REM.

F1 (=10Ca+10Mg+2B+REM) is an index indicating the extent to which a decrease in the hot workability of the steel material caused by S is suppressed. Within the ranges of the contents of elements described above, if F1 is 0.0010 or more, a decrease in the hot workability of the steel material caused by S can be sufficiently suppressed. As a result, on the premise that the contents of the elements are within the ranges described above, the formation of an inner surface flaw on the steel material can be suppressed. Therefore, in the martensitic stainless steel seamless pipe according to the present embodiment, within the ranges of the contents of elements described above, F1 is to be 0.0010 or more.

A lower limit of F1 is preferably 0.0030, more preferably 0.0050, further preferably 0.0100, and further preferably is 0.0120. An upper limit of F1 is not particularly limited. However, because the contents of the elements pertaining to F1 are within the ranges of the contents of the elements of the martensitic stainless steel seamless pipe according to the present embodiment, the upper limit of F1 is substantially 0.7400. The upper limit of F1 is preferably 0.7000, more preferably 0.6000, and further preferably 0.5000.

In short, within the ranges of the contents of elements described above, the martensitic stainless steel seamless pipe according to the present embodiment contains one or more elements selected from the group consisting of:

Ca: 0.0001 to 0.0250%,

Mg: 0.0001 to 0.0250%,

B: 0.0005 to 0.0200%, and rare earth metal: 0.001 to 0.200%.

In this case, F1 is 0.0010 or more, and a decrease in the hot workability of the steel material caused by S can be sufficiently suppressed.

[Regarding Formula (2)]

Preferably, in the martensitic stainless steel seamless pipe according to the present embodiment, within the ranges of the contents of elements described above, contents of elements satisfy Formula (2):

$$0.05Mo+W \geq \alpha \quad (2)$$

where, $\alpha$ in Formula (2) is 0.240 in a case where, among the elements of the martensitic stainless steel seamless pipe, the Cu content is less than 0.50%, and is 0.200 in a case where the Cu content is 0.50 to 3.50%. The content in mass % of the corresponding element is substituted for W and Mo in Formula (2).

F2 is defined as F2=0.05Mo+W. F2 is an index relating to the melting point of oxides formed during hot working. Within the ranges of the contents of elements described above, if F2 is 0.240 or more, the melting point of oxides during hot working will additionally decrease. In this case, the maximum depth of an inner surface flaw on the steel material will be even shallower. That is, an inner surface flaw on the martensitic stainless steel seamless pipe can be further suppressed. Therefore, in the martensitic stainless steel seamless pipe according to the present embodiment, within the ranges of the contents of elements described above, preferably F2 is made 0.240 or more.

A more preferable lower limit of F2 is 0.250, further preferably is 0.255, and further preferably is 0.260. An upper limit of F2 is not particularly limited. However, with the aforementioned chemical composition, the upper limit of F2 is substantially 0.550. Note that, in the martensitic stainless steel seamless pipe according to the present embodiment, if the chemical composition described above is satisfied, even if F2 is less than 0.240, the formation of an inner surface flaw can be suppressed, but if F2 is 0.240 or more, the formation of an inner surface flaw is further suppressed.

In addition, in a case where the Cu content is 0.50% or more, if F2 is 0.200 or more, the formation of an inner surface flaw is further suppressed. Note that, the reason an inner surface flaw can be suppressed by raising the Cu content to 0.50% or more even if F2 is low has not been clarified. However, the fact that if the Cu content is 0.50% or more, an inner surface flaw can be suppressed even if F2 is low has been proven by Examples that are described later.

Therefore, in the martensitic stainless steel seamless pipe according to the present embodiment, when the contents of the elements are within the ranges described above and the Cu content is 0.50% or more, preferably F2 is made 0.200 or more. In a case where the Cu content is 0.50% or more, a more preferable lower limit of F2 is 0.220, and further preferably is 0.240.

[Microstructure]

The microstructure of the martensitic stainless steel seamless pipe according to the present embodiment is mainly composed of martensite. In the present description, the term "martensite" includes not only fresh martensite but also tempered martensite. Moreover, in the present description, the phrase "mainly composed of martensite" means that the volume ratio of martensite is 80.0% or more in the microstructure. The balance of the microstructure is retained austenite. That is, the volume ratio of retained austenite is 0 to 20.0% in the martensitic stainless steel seamless pipe of the present embodiment. The volume ratio of retained austenite is preferably as low as possible. A lower limit of the volume ratio of martensite in the microstructure of the martensitic stainless steel seamless pipe of the present embodiment is preferably 85.0%, and more preferably 90.0%. Further preferably, the microstructure of the steel material is composed of a martensite single phase.

[Method for Measuring Volume Ratio of Martensite]

The volume ratio (%) of martensite in the microstructure of the martensitic stainless steel seamless pipe of the present embodiment can be obtained by subtracting the volume ratio (%) of retained austenite, which is obtained by the following method, from 100.0%.

The volume ratio of retained austenite can be obtained by an X-ray diffraction method. Specifically, test specimens are taken from the center portion of the wall thickness of the martensitic stainless steel seamless pipe. The size of the test specimens is, although not particularly limited, for example, 15 mm×15 mm×a thickness of 2 mm. In this case, the thickness direction of the test specimens is parallel with the pipe diameter direction of the martensitic stainless steel seamless pipe. Using the obtained test specimens, the X-ray diffraction intensity of each of the (200) plane of $\alpha$ phase (ferrite and martensite), the (211) plane of $\alpha$ phase, the (200) plane of $\gamma$ phase (retained austenite), the (220) plane of $\gamma$ phase, and the (311) plane of $\gamma$ phase is measured to calculate an integrated intensity of each plane. In the measurement of the X-ray diffraction intensity, the target of the X-ray diffraction apparatus is Mo (Mo K$\alpha$ radiation), and the output thereof is 50 kV-40 mA. After calculation, the volume ratio V$\gamma$ (%) of retained austenite is calculated using Formula (I) for combinations (2×3=6 pairs) of each plane of the $\alpha$ phase and each plane of the $\gamma$ phase. Then, an average value of the volume ratios V$\gamma$ of retained austenite of the six pairs is defined as the volume ratio (%) of retained austenite.

$$V\gamma=100/\{1+(I\alpha\times R\gamma)/(I\gamma\times R\alpha)\} \quad (I)$$

Where, I$\alpha$ is an integrated intensity of $\alpha$ phase. R$\alpha$ is a crystallographic theoretical calculation value of $\alpha$ phase. I$\gamma$ is an integrated intensity of $\gamma$ phase. R$\gamma$ is a crystallographic theoretical calculation value of $\gamma$ phase. In the present description, R$\alpha$ in the (200) plane of $\alpha$ phase is 15.9, R$\alpha$ in the (211) plane of $\alpha$ phase is 29.2, and R$\gamma$ in the (200) plane of γ phase is 35.5, Rγ in the (220) plane of γ phase is 20.8, and Rγ in the (311) plane of γ phase is 21.8. Note that the volume ratio of retained austenite is obtained by rounding off the second decimal place of an obtained numerical value.

Using the volume ratio (%) of retained austenite obtained by the above-described X-ray diffraction method, the volume ratio (%) of martensite of the microstructure of the martensitic stainless steel seamless pipe is obtained by the following Formula.

Volume ratio of martensite=100.0−volume ratio of retained austenite (%)

[Yield Strength]

The martensitic stainless steel seamless pipe according to the present embodiment has a yield strength of 655 MPa or more (95 ksi or more). In the present description, the yield strength means 0.2% offset proof stress (MPa) which is obtained by a tensile test at normal temperature (24±3° C.) in conformity with ASTM E8/E8M (2013).

It is proven by Examples that are described later that as long as the martensitic stainless steel seamless pipe according to the present embodiment has the contents of the elements described above, satisfies Formula (1), and the yield strength thereof is at least 655 MPa or more, the martensitic stainless steel seamless pipe has the excellent corrosion resistance and, in addition, formation of an inner surface flaw is suppressed. Note that, an upper limit of the yield strength of the martensitic stainless steel seamless pipe according to the present embodiment is not particularly limited. The upper limit of the yield strength, for example, may be 1034 MPa, may be 1000 MPa, or may be 965 MPa.

Specifically, in the present embodiment, the yield strength can be obtained by the following method. A round bar specimen is taken from the center portion of the wall thickness of the martensitic stainless steel seamless pipe. The round bar specimen, for example, is a specimen having a parallel portion diameter of 6.0 mm and a parallel portion length of 40.0 mm. Note that, the longitudinal direction of the parallel portion of the round bar specimen is made parallel with the pipe axis direction of the martensitic stainless steel seamless pipe. A tensile test is conducted at normal temperature (24±3° C.) in conformity with ASTM E8/E8M (2013) using the round bar specimen to obtain 0.2% offset proof stress (MPa). The obtained 0.2% offset proof stress is adopted as the yield strength (MPa).

[Corrosion Resistance]

The martensitic stainless steel seamless pipe according to the present embodiment has the excellent corrosion resistance. In the present embodiment, the excellent corrosion resistance is defined as described hereunder.

In the present embodiment, the corrosion resistance is evaluated by means of a four-point bending test. Specifically, first, a test specimen is taken from the center portion of the wall thickness of the steel material according to the present embodiment. The size of the test specimen is, for example, 2 mm in thickness, 10 mm in width, and 75 mm in length. Note that, the longitudinal direction of the test specimen is to be parallel with the pipe axis direction of the martensitic stainless steel seamless pipe. A 25 wt % sodium chloride aqueous solution adjusted to pH 4.5 is adopted as the test solution.

In conformity with ASTM G39-99 (2011), stress corresponding to 100% of the actual yield stress is applied to the test specimen by four-point bending. The test specimen to which stress has been applied is enclosed in an autoclave together with the test jig. The test solution is poured into the autoclave so as to leave a vapor phase portion, and this is adopted as the test bath. After the test bath is degassed, a mixed gas of $H_2S$ gas at 0.03 bar and $CO_2$ gas at 30 bar is sealed under pressure in the autoclave, and the test bath is stirred to cause the mixed gas to saturate. After sealing the autoclave, the test bath is stirred at 180° C. for 720 hours.

If cracking is not confirmed in the test specimen after 720 hours elapsed under the conditions described above, it is determined that the martensitic stainless steel seamless pipe according to the present embodiment "has excellent corrosion resistance". Note that, in the present description, the phrase "cracking is not confirmed" means that cracking is not confirmed in a case where the test specimen after the test is observed by the naked eye.

[Inner Surface Flaw on Seamless Pipe]

On the martensitic stainless steel seamless pipe according to the present embodiment, formation of an inner surface flaw is suppressed. In the present embodiment the phrase "formation of an inner surface flaw is suppressed" is defined as described hereunder.

Specifically, piercing-rolling that simulates production of the martensitic stainless steel seamless pipe according to the present embodiment is performed according to specific conditions, and the maximum depth of an inner surface flaw on the obtained steel material is measured. More specifically, after a starting material (round billet) having the chemical composition described above is heated to 1230° C., piercing-rolling is performed in which the area reduction ratio is set to 65%. Thereafter, a heat treatment that is described later is performed to thereby obtain a martensitic stainless steel seamless pipe. An inner surface flaw formed on the inner surface of the obtained seamless pipe is confirmed by visual observation, and the depth of the formed flaw is measured using a vernier calipers. The maximum value of the depth of the flaw that is obtained is defined as the maximum depth (mm) of the inner surface flaw. If the maximum depth of an inner surface flaw is less than 0.3 mm, it is determined that "formation of an inner surface flaw is suppressed" on the martensitic stainless steel seamless pipe.

[Load on Piercing-Rolling Mill]

In the martensitic stainless steel seamless pipe according to the present embodiment, preferably the W content is 0.01 to 0.25%. In this case, the martensitic stainless steel seamless pipe can also reduce the load applied to a piercing-rolling mill. In the present embodiment, the phrase "load applied to a piercing-rolling mill is reduced" is defined as described hereunder.

Specifically, the martensitic stainless steel seamless pipe according to the present embodiment is subjected to a hot workability test (Gleeble test). A test specimen for the Gleeble test is taken from the steel material according to the present embodiment. The test specimen is taken from a center portion of the wall thickness of the seamless pipe. The test specimen is, for example, a round bar specimen having a parallel portion diameter of 10 mm, and a parallel portion length of 130 mm. Note that, the longitudinal direction of the test specimen is made parallel with the pipe axis direction of the martensitic stainless steel seamless pipe.

The test specimen heated to 1250° C. is cooled at a cooling rate of 100° C./min, and tensile stress is applied at 1100° C. to cause the test specimen to break. The maximum stress (MPa) until the test specimen breaks is determined, and is defined as "hot tensile strength". If the obtained hot tensile strength (MPa) is 130 MPa or less, it is determined that "a load applied to a piercing-rolling mill is reduced" by the martensitic stainless steel seamless pipe.

[Uses of Seamless Pipe]

Uses of the martensitic stainless steel seamless pipe according to the present embodiment are not particularly limited. The martensitic stainless steel seamless pipe according to the present embodiment is suitable for a seamless pipe for oil wells. Examples of the seamless pipe for oil wells include a casing pipe, a tubing pipe, a drilling pipe, and the like, which are used for drilling of an oil well or a gas well, collection of crude oil or natural gas, and the like.

[Production Method]

An example of the production method of the martensitic stainless steel seamless pipe of the present embodiment will be described. Note that the production method to be described below is an example, and a method for producing a martensitic stainless steel seamless pipe of the present embodiment will not be limited thereto. That is, as long as a martensitic stainless steel seamless pipe of the present embodiment having the above-described configuration can be produced, the production method will not be limited to the production method to be described below, and the martensitic stainless steel seamless pipe may be produced by another production method. Preferably, the method for producing the martensitic stainless steel seamless pipe according to the present embodiment includes a starting material preparation process, a hot working process, and a heat treatment process. Hereunder, a case where the production method includes a starting material preparation process, a hot working process, and a heat treatment process is described in detail.

[Starting Material Preparation Process]

In the starting material preparation process, molten steel having the above-described chemical composition is produced by a well-known refining method. By using the produced molten steel, a cast piece is produced through a continuous casting process. Here, the cast piece is a slab, a bloom, or a billet. In place of the cast piece, an ingot may be produced by an ingot-making process using the aforementioned molten steel. As needed, the slab, the bloom, or the ingot may be subjected to hot rolling to produce a billet. The starting material (slab, bloom, or billet) is produced by the above-described production process.

[Hot Working Process]

In the hot working process, the prepared starting material is subjected to hot working. First, the starting material is heated in a heating furnace. The heating temperature is, although not particularly limited, for example, 1100 to 1300° C. The starting material extracted from the heating furnace is subjected to hot working to produce a hollow shell (seamless pipe). Specifically, in the present embodiment, piercing-rolling is performed as hot working to produce a hollow shell. In the piercing-rolling, although not particularly limited, the piercing ratio is, for example, 1.0 to 4.0. The billet after piercing-rolling is subjected to elongation rolling using a mandrel mill. As needed, the billet after elongation rolling is further subjected to diameter adjusting rolling using a reducer or a sizing mill. The hollow shell is produced by the above-described processes. A cumulative reduction of area in the hot working process is, although not particularly limited, for example, 20 to 70%.

[Heat Treatment Process]

The heat treatment process includes a quenching process and a tempering process. In the heat treatment process, first, the hollow shell produced in the hot working process is subjected to quenching (quenching process). The hollow shell after quenching is subjected to tempering (tempering process). Hereunder, the quenching process and the tempering process are each described.

[Quenching Process]

In the quenching process, quenching is performed by a well-known method. In the present description, the term "quenching" means rapidly cooling a hollow shell which is at a temperature not lower than the $A_3$ point. Quenching may be performed immediately after hot working without cooling the hollow shell to normal temperature after the hot working (direct quenching), or quenching may be performed after charging the hollow shell into a heat treatment furnace or supplementary heating furnace before the temperature of the hollow shell after hot working decreases, and bringing the hollow shell to a quenching temperature.

The quenching temperature is not lower than the $A_{c3}$ transformation point and is, for example, 900 to 1000° C. Here, the term "quenching temperature" means the furnace temperature in the case of using a heat treatment furnace or a supplementary heating furnace, and means the temperature of the outer surface of the hollow shell in the case of direct quenching. In the case of using a heat treatment furnace or a supplementary heating furnace, in addition, although not particularly limited, the time for which the hollow shell is held at the quenching temperature is, for example, 10 to 120 minutes.

Although not particularly limited, the quenching method is, for example, water cooling. As a method for quenching the hollow shell by water cooling, specifically, the hollow shell may be rapidly cooled by immersing it in a water bath or oil bath. Alternatively, the hollow shell may be rapidly cooled by pouring or jetting cooling water onto the outer surface and/or the inner surface of the hollow shell by means of shower cooling or mist cooling.

[Tempering Process]

In the tempering process, the hollow shell that was quenched is subjected to tempering to adjust the yield strength. In the present description, the term "tempering" means reheating the hollow shell after quenching to a temperature that is not more than the $A_{c1}$ point and holding the hollow shell at that temperature. In the tempering process according to the present embodiment, the tempering temperature is set within the range of 500° C. to the $A_{c1}$ transformation point. In the tempering process according to the present embodiment, although a tempering time is not particularly limited, for example, the tempering time is 10 to 180 minutes. In the present description, the term "tempering temperature" means the furnace temperature (° C.) in a heat treatment furnace. In the present description, the term "tempering time" means a time for which the hollow shell is held at the tempering temperature.

In the tempering process according to the present embodiment, the tempering temperature and tempering time are adjusted according to the contents of elements of the hollow shell and the yield strength to be obtained. Specifically, for example, in a case where the yield strength of a hollow shell having the contents of elements described above is to be made to fall within the range of 655 to less than 862 MPa, it is preferable to set the tempering temperature to 570 to 620° C. and to set the tempering time to 10 to 30 minutes. Further, for example, in a case where the yield strength of the hollow shell in which the Cu content is less than 0.50% is to be made 862 MPa or more, it is preferable to set the tempering temperature to 520 to 570° C. and to set the tempering time to 30 to 60 minutes. In addition, for example, in a case where the yield strength of the hollow shell in which the Cu content is 0.50% or more is to be made 862 MPa or more, it is preferable to set the tempering temperature to 510 to 570° C. and to set the tempering time to 60 to 100 minutes.

Obtaining a martensitic stainless steel seamless pipe having a yield strength of 655 MPa or more by appropriately adjusting the tempering temperature and the tempering time according to the contents of the elements of a hollow shell as described above is something which those skilled in the art are capable of carrying out as a matter of course.

The martensitic stainless steel seamless pipe according to the present embodiment can be produced by the processes described above. Note that, as mentioned above, the martensitic stainless steel seamless pipe may be produced by a method other than the production method described above. In addition, as needed, the produced martensitic stainless steel seamless pipe may be subjected to a post-treatment. The post-treatment is, for example, descaling that removes oxide scale formed on the surface of the steel material. Hereunder, the present invention is described more specifically by way of examples.

Example 1

In Example 1, the maximum depth of an inner surface flaw, the corrosion resistance, and the load on a piercing-rolling mill were investigated with respect to martensitic stainless steel seamless pipes having a Cu content of less than 0.50%. Specifically, molten steels having the chemical compositions shown in Table 1 were melted using a 50-kg vacuum furnace, and ingots were produced by an ingot-making process.

TABLE 1

| | Chemical composition (in mass %, balance being Fe and impurities) | | | | | | | | | | | | | |
|---|---|---|---|---|---|---|---|---|---|---|---|---|---|---|
| Steel | C | Si | Mn | P | S | Al | N | Ni | Cr | Cu | Mo | W | V | Co |
| A | 0.010 | 0.49 | 1.51 | 0.016 | 0.0006 | 0.024 | 0.006 | 5.62 | 13.56 | 0.39 | 2.84 | 0.01 | 0.051 | 0.091 |
| B | 0.012 | 0.67 | 0.51 | 0.026 | 0.0056 | 0.066 | 0.000 | 3.05 | 12.12 | 0.42 | 4.19 | 0.18 | 0.087 | 0.081 |
| C | 0.015 | 0.87 | 1.46 | 0.024 | 0.0057 | 0.028 | 0.001 | 5.21 | 11.91 | 0.31 | 2.38 | 0.16 | 0.101 | 0.144 |
| D | 0.014 | 0.79 | 1.06 | 0.018 | 0.0018 | 0.038 | 0.002 | 5.69 | 12.08 | 0.38 | 2.01 | 0.15 | 0.086 | 0.121 |
| E | 0.038 | 0.91 | 1.28 | 0.005 | 0.0056 | 0.041 | 0.011 | 7.21 | 15.26 | 0.24 | 2.19 | 0.12 | 0.107 | 0.221 |
| F | 0.024 | 0.69 | 0.94 | 0.011 | 0.0081 | 0.027 | 0.017 | 6.07 | 11.53 | 0.16 | 2.98 | 0.07 | 0.098 | 0.129 |
| G | 0.019 | 0.07 | 0.08 | 0.027 | 0.0033 | 0.030 | 0.003 | 6.44 | 12.52 | 0.42 | 2.02 | 0.20 | 0.145 | 0.241 |
| H | 0.028 | 0.34 | 1.10 | 0.011 | 0.0085 | 0.082 | 0.002 | 7.63 | 13.97 | 0.16 | 3.72 | 0.22 | 0.069 | 0.218 |
| I | 0.004 | 0.51 | 0.12 | 0.016 | 0.0008 | 0.074 | 0.003 | 8.49 | 12.85 | 0.11 | 3.44 | 0.09 | 0.070 | 0.156 |
| J | 0.021 | 0.93 | 0.54 | 0.028 | 0.0015 | 0.061 | 0.010 | 5.42 | 13.21 | 0.37 | 2.58 | 0.04 | 0.052 | 0.199 |
| K | 0.012 | 0.10 | 1.21 | 0.030 | 0.0100 | 0.071 | 0.000 | 5.24 | 14.22 | 0.32 | 1.85 | 0.09 | 0.121 | 0.083 |
| L | 0.002 | 0.62 | 0.42 | 0.001 | 0.0037 | 0.010 | 0.004 | 5.72 | 11.88 | 0.25 | 3.46 | 0.22 | 0.062 | 0.147 |
| M | 0.008 | 0.15 | 0.58 | 0.020 | 0.0062 | 0.031 | 0.008 | 5.01 | 11.99 | 0.14 | 2.18 | 0.18 | 0.077 | 0.086 |
| N | 0.019 | 0.06 | 1.79 | 0.014 | 0.0079 | 0.043 | 0.007 | 3.30 | 11.89 | 0.47 | 2.54 | 0.15 | 0.105 | 0.128 |
| O | 0.014 | 0.67 | 0.82 | 0.005 | 0.0040 | 0.061 | 0.006 | 5.41 | 12.32 | 0.09 | 2.28 | 0.06 | 0.079 | 0.182 |
| P | 0.008 | 0.64 | 1.74 | 0.030 | 0.0004 | 0.050 | 0.000 | 6.49 | 13.67 | 0.35 | 3.32 | 0.24 | 0.082 | 0.204 |
| Q | 0.007 | 0.09 | 1.59 | 0.011 | 0.0015 | 0.053 | 0.006 | 4.75 | 13.73 | 0.16 | 2.69 | 0.16 | 0.059 | 0.163 |
| R | 0.010 | 0.98 | 1.30 | 0.025 | 0.0095 | 0.044 | 0.004 | 6.01 | 13.11 | 0.09 | 2.98 | — | 0.195 | 0.175 |
| S | 0.040 | 0.52 | 0.60 | 0.016 | 0.0076 | 0.016 | 0.005 | 7.26 | 12.23 | 0.25 | 3.12 | 0.28 | 0.053 | 0.092 |
| T | 0.010 | 0.47 | 0.81 | 0.028 | 0.0054 | 0.028 | 0.014 | 5.21 | 11.98 | 0.15 | 2.92 | 0.11 | 0.112 | 0.179 |
| U | 0.008 | 0.26 | 0.98 | 0.018 | 0.0053 | 0.040 | 0.015 | 4.76 | 12.31 | 0.21 | 2.27 | 0.09 | 0.087 | — |
| V | 0.011 | 0.27 | 0.55 | 0.017 | 0.0012 | 0.036 | 0.008 | 5.41 | 12.08 | 0.25 | 3.24 | 0.09 | 0.067 | — |

| | Chemical composition (in mass %, balance being Fe and impurities) | | | | | | | | | | | |
|---|---|---|---|---|---|---|---|---|---|---|---|---|
| Steel | Ca | Mg | B | REM | Nb | Ta | Ti | Zr | Hf | Sn | F1 | F2 |
| A | 0.0027 | — | — | — | — | — | — | — | — | — | 0.0270 | 0.152 |
| B | — | 0.0084 | — | — | — | — | — | — | — | — | 0.0840 | 0.390 |
| C | — | — | 0.0124 | — | — | — | — | — | — | — | 0.0248 | 0.279 |
| D | — | — | — | 0.140 | — | — | — | — | — | — | 0.1400 | 0.251 |
| E | 0.0038 | — | 0.0016 | — | — | — | — | — | — | — | 0.0412 | 0.230 |
| F | — | 0.0074 | — | 0.094 | — | — | — | — | — | — | 0.1680 | 0.219 |
| G | 0.0046 | — | — | — | — | — | — | — | — | — | 0.0460 | 0.301 |
| H | — | 0.0090 | — | — | — | — | — | — | — | — | 0.0900 | 0.406 |
| I | 0.0035 | — | — | — | — | 0.067 | — | — | — | — | 0.0350 | 0.262 |
| J | — | 0.0125 | — | — | — | — | 0.043 | — | — | — | 0.1250 | 0.169 |
| K | — | — | 0.0146 | — | — | — | — | 0.070 | — | — | 0.0292 | 0.183 |
| L | — | — | — | 0.013 | — | — | — | — | 0.094 | — | 0.0130 | 0.393 |
| M | 0.0048 | — | 0.0154 | — | — | — | — | — | — | 0.037 | 0.0788 | 0.289 |
| N | — | — | — | 0.180 | 0.088 | — | — | — | — | — | 0.1800 | 0.277 |
| O | 0.0098 | — | — | 0.130 | 0.005 | 0.052 | — | — | — | — | 0.2280 | 0.174 |
| P | 0.0072 | 0.0170 | — | — | 0.011 | — | 0.099 | — | — | — | 0.2420 | 0.406 |
| Q | 0.0024 | — | — | 0.020 | — | 0.099 | 0.097 | — | — | — | 0.0440 | 0.295 |
| R | — | 0.0138 | — | 0.102 | — | — | — | — | — | — | 0.2400 | 0.149 |
| S | 0.0049 | — | 0.0193 | — | — | — | — | — | — | — | 0.0876 | 0.436 |
| T | — | — | — | — | 0.028 | — | — | — | — | — | 0.0000 | 0.256 |
| U | 0.0029 | 0.0074 | — | — | — | — | 0.028 | — | — | — | 0.1030 | 0.204 |
| V | 0.0038 | 0.0070 | — | — | 0.028 | — | — | — | — | — | 0.1080 | 0.252 |

Note that the symbol "–" in Table 1 means that the content of the corresponding element was at an impurity level. For example, it means that the respective contents of Ca, Mg, and B of steel D were 0% when rounded off to four decimal places. For example, it means that the respective contents of REM, Nb, Ta, Ti, Zr, Hf, and Sn of steel A were 0% when rounded off to three decimal places. Further, F1 that was obtained based on the chemical composition described in Table 1 and the definition described above is shown in Table 1. In addition, F2 that was obtained based on the chemical composition described in Table 1 and the definition described above is shown in Table 1.

Ingots of Test Numbers 1 to 44 were heated at 1250° C. for three hours, and then subjected to hot forging to produce round billets having a diameter of 200 mm. The round billets of Test Numbers 1 to 44 after hot forging were held at 1230° C. for 120 minutes, and then subjected to piercing-rolling by a test piercing machine. The area reduction ratio during the piercing-rolling was 65%. In this way, hollow shells having an outer diameter of 139.7 mm and a wall thickness of 12.09 mm were produced.

The hollow shells of Test Numbers 1 to 44 were subjected to quenching. The quenching was performed by reheating each hollow shell in a heat treatment furnace, and then immersing the hollow shell in a water bath. For the hollow shells of Test Numbers 1 to 44, the quenching temperature (furnace temperature of heat treatment furnace) was 900° C., and the time for which each hollow shell was held at the quenching temperature was 60 minutes. The hollow shells of Test Numbers 1 to 44 after quenching were subjected to tempering. The tempering was performed by reheating each hollow shell after quenching in a tempering furnace, and holding the hollow shell at the tempering temperature. For Test Numbers 1 to 44, the tempering temperature and tempering time employed for the tempering are shown in Table 2. Seamless pipes of Test Numbers 1 to 44 were produced by the foregoing production process.

TABLE 2

| | | | Tempering | | | Inner surface | | |
|---|---|---|---|---|---|---|---|---|
| Test No. | Steel | F2 | Tempering temperature (° C.) | Tempering time (min) | Yield strength (MPa) | flaw maximum depth (mm) | Hot tensile strength (MPa) | Corrosion resistance test |
| 1 | A | 0.152 | 590 | 30 | 802 | 0.2 | 109 | E |
| 2 | B | 0.390 | 620 | 20 | 856 | 0.0 | 125 | E |
| 3 | C | 0.279 | 610 | 20 | 762 | 0.1 | 122 | E |
| 4 | D | 0.251 | 620 | 20 | 846 | 0.1 | 120 | E |
| 5 | E | 0.230 | 610 | 30 | 823 | 0.2 | 117 | E |
| 6 | F | 0.219 | 590 | 30 | 788 | 0.2 | 114 | E |
| 7 | G | 0.301 | 580 | 20 | 841 | 0.0 | 124 | E |
| 8 | H | 0.406 | 620 | 10 | 810 | 0.0 | 124 | E |
| 9 | I | 0.262 | 620 | 20 | 681 | 0.1 | 115 | E |
| 10 | J | 0.169 | 600 | 10 | 821 | 0.2 | 111 | E |
| 11 | K | 0.183 | 590 | 20 | 819 | 0.2 | 118 | E |
| 12 | L | 0.393 | 600 | 10 | 831 | 0.0 | 125 | E |
| 13 | M | 0.289 | 590 | 30 | 808 | 0.1 | 124 | E |
| 14 | N | 0.277 | 570 | 30 | 839 | 0.1 | 121 | E |
| 15 | O | 0.174 | 590 | 20 | 672 | 0.2 | 113 | E |
| 16 | P | 0.406 | 580 | 30 | 780 | 0.0 | 127 | E |
| 17 | Q | 0.295 | 600 | 20 | 772 | 0.1 | 121 | E |
| 18 | R | 0.149 | 620 | 20 | 810 | 0.4 | 108 | E |
| 19 | S | 0.436 | 610 | 30 | 783 | 0.0 | 132 | E |
| 20 | T | 0.256 | 620 | 20 | 810 | 0.3 | 113 | E |
| 21 | U | 0.204 | 590 | 30 | 815 | 0.2 | 116 | NA |
| 22 | V | 0.252 | 610 | 20 | 828 | 0.3 | 116 | NA |
| 23 | A | 0.152 | 530 | 60 | 939 | 0.2 | 109 | E |
| 24 | B | 0.390 | 530 | 60 | 914 | 0.0 | 125 | E |
| 25 | C | 0.279 | 520 | 50 | 954 | 0.1 | 122 | E |
| 26 | D | 0.251 | 520 | 40 | 868 | 0.1 | 120 | E |
| 27 | E | 0.230 | 550 | 50 | 884 | 0.2 | 117 | E |
| 28 | F | 0.219 | 530 | 50 | 901 | 0.2 | 114 | E |
| 29 | G | 0.301 | 520 | 60 | 899 | 0.0 | 124 | E |
| 30 | H | 0.406 | 530 | 50 | 876 | 0.0 | 124 | E |
| 31 | I | 0.262 | 550 | 60 | 881 | 0.1 | 115 | E |
| 32 | J | 0.169 | 540 | 50 | 963 | 0.2 | 111 | E |
| 33 | K | 0.183 | 530 | 40 | 931 | 0.2 | 118 | E |
| 34 | L | 0.393 | 530 | 60 | 920 | 0.0 | 125 | E |
| 35 | M | 0.289 | 540 | 60 | 865 | 0.1 | 124 | E |
| 36 | N | 0.277 | 540 | 30 | 890 | 0.1 | 121 | E |
| 37 | O | 0.174 | 520 | 60 | 942 | 0.2 | 113 | E |
| 38 | P | 0.406 | 530 | 60 | 959 | 0.0 | 127 | E |
| 39 | Q | 0.295 | 550 | 50 | 880 | 0.1 | 121 | E |
| 40 | R | 0.149 | 540 | 50 | 925 | 0.4 | 108 | E |
| 41 | S | 0.436 | 570 | 50 | 960 | 0.0 | 132 | E |
| 42 | T | 0.256 | 530 | 30 | 893 | 0.3 | 113 | E |
| 43 | U | 0.204 | 550 | 50 | 869 | 0.2 | 116 | NA |
| 44 | V | 0.252 | 520 | 40 | 923 | 0.3 | 116 | NA |

[Evaluation Tests]

The produced seamless pipes of Test Numbers 1 to 44 were subjected to a tensile test, a test to measure the maximum depth of an inner surface flaw, a hot tensile strength measurement test, and a corrosion resistance test.

[Tensile Test]

The seamless pipes of Test Numbers 1 to 44 were subjected to a tensile test. Specifically, a round bar specimen for a tensile test was taken from a center portion of the wall thickness of the respective seamless pipes of Test Numbers 1 to 44. The round bar specimen was taken so as to have a parallel portion diameter of 6.0 mm and a parallel portion length of 40.0 mm. Note that, the longitudinal direction of the round bar specimen was made parallel with the pipe axis direction of the seamless pipe. A tensile test was conducted at normal temperature (24±3° C.) in conformity with ASTM E8/E8M (2013) using the round bar specimens. The 0.2% offset proof stress obtained in the tensile test was adopted as the yield strength (MPa). For Test Numbers 1 to 44, the obtained yield strength (MPa) is shown in Table 2.

[Test to Measure Maximum Depth of Inner Surface Flaw]

The seamless pipes of Test Numbers 1 to 44 were subjected to a test to measure the maximum depth of an inner surface flaw. Specifically, the inner surface of the seamless pipe of each of Test Numbers 1 to 44 was checked by visual observation, and an inner surface flaw was identified. The depth of the identified inner surface flaw was measured using a vernier calipers. The maximum value of the depth of the inner surface flaw that was measured was defined as the maximum depth (mm) of the inner surface flaw. The maximum depth (mm) of the inner surface flaw obtained for each of Test Numbers 1 to 44 is shown in Table 2.

[Hot Tensile Strength Measurement Test]

A hot tensile strength measurement test was conducted on the seamless pipes of Test Numbers 1 to 44. Specifically, a test specimen for the Gleeble test was taken from a center portion of the wall thickness of the seamless pipe of each of Test Numbers 1 to 44. A round bar specimen having a parallel portion diameter of 10 mm and a parallel portion length of 130 mm was taken as the test specimen. Note that, the longitudinal direction of the parallel portion of the round bar specimen was made parallel with the pipe axis direction of the seamless pipe. The round bar specimen heated to 1250° C. was cooled at a cooling rate of 100° C./min, and subjected to a tensile test at 1100° C. to cause the round bar specimen to break. The maximum stress (MPa) until the round bar specimen broke was determined, and was defined as "hot tensile strength". The hot tensile strength (MPa) obtained for each of Test Numbers 1 to 44 is shown in Table 2.

[Corrosion Resistance Test]

A corrosion resistance test was conducted on the seamless pipes of Test Numbers 1 to 44. Specifically, a test specimen for a four-point bending test was taken from a center portion of the wall thickness of the seamless pipe of each of Test Numbers 1 to 44. The test specimen had a thickness of 2 mm, a width of 10 mm, and a length of 75 mm. Note that, the longitudinal direction of the test specimen was made parallel with the pipe axis direction of the seamless pipe. A 25 wt % sodium chloride aqueous solution adjusted to pH 4.5 was adopted as the test solution. In conformity with ASTM G39-99 (2011), stress corresponding to 100% of the actual yield stress was applied to the test specimen by four-point bending.

The test specimen to which stress had been applied was enclosed in an autoclave together with the test jig. The test solution was poured into the autoclave so as to leave a vapor phase portion, and this was adopted as the test bath. After the test bath was degassed, a mixed gas of $H_2S$ gas at 0.03 bar and $CO_2$ gas at 30 bar was sealed under pressure in the autoclave, and the test bath was stirred to cause the mixed gas to saturate. After sealing the autoclave, the test bath was stirred at 180° C. for 720 hours. After being held for 720 hours, the test specimens of Test Numbers 1 to 44 were observed to check for the occurrence of cracking. Specifically, after being held for 720 hours, each test specimen was observed with the naked eye. Test specimens in which cracking was not confirmed as the result of the observation were determined as being "E" (Excellent). On the other hand, test specimens in which cracking was confirmed were determined as being "NA" (Not Acceptable). The evaluation results obtained for Test Numbers 1 to 44 are shown in Table 2.

[Test Results]

Referring to Table 1 and Table 2, in the seamless pipes of Test Numbers 1 to 17, 19, 23 to 39, and 41, the chemical composition was appropriate and F1 was 0.0010 or more. In addition, in these seamless pipes, the yield strength was 655 MPa or more. As a result, the maximum depth of an inner surface flaw was less than 0.3 mm, and thus the formation of an inner surface flaw had been suppressed. In addition, the evaluation obtained in the corrosion resistance test was "E", which indicated the excellent corrosion resistance.

In the seamless pipes of Test Numbers 1 to 17 and 23 to 39, furthermore, the W content was 0.01 to 0.25%. As a result, the hot tensile strength was 130 MPa or less, and thus the load applied to the piercing-rolling mill was reduced.

In addition, in the seamless pipes of Test Numbers 2 to 4, 7 to 9, 12 to 14, 16, 17, 19, 24 to 26, 29 to 31, 34 to 36, 38, 39, and 41, F2 was 0.240 or more. As a result, the maximum depth of an inner surface flaw was 0.1 mm or less, and thus formation of an inner surface flaw had been further suppressed.

On the other hand, in the seamless pipes of Test Numbers 18 and 40, the W content was too low. As a result, the maximum depth of an inner surface flaw was 0.3 mm or more, and formation of an inner surface flaw had not been suppressed.

The seamless pipes of Test Numbers 20 and 42 did not contain any of Ca, Mg, B, and REM, and thus F1 was less than 0.0010. As a result, the maximum depth of an inner surface flaw was 0.3 mm or more, and formation of an inner surface flaw had not been suppressed.

The seamless pipes of Test Numbers 21, 22, 43, and 44 did not contain Co. As a result, the evaluation in the corrosion resistance test was "NA", and thus excellent the corrosion resistance was not exhibited.

Example 2

In Example 2, the maximum depth of an inner surface flaw, the corrosion resistance, and the load on a piercing-rolling mill were investigated with respect to martensitic stainless steel seamless pipes having a Cu content of 0.50 to 3.50%. Specifically, molten steels having the chemical compositions shown in Table 3 were melted using a 50 kg vacuum furnace, and ingots were produced by an ingot-making process.

TABLE 3

| Steel | Chemical composition (in mass %, balance being Fe and impurities) | | | | | | | | | | | | | |
|---|---|---|---|---|---|---|---|---|---|---|---|---|---|---|
| | C | Si | Mn | P | S | Al | N | Ni | Cr | Cu | Mo | W | V | Co |
| W | 0.019 | 0.17 | 0.33 | 0.016 | 0.0072 | 0.022 | 0.010 | 4.25 | 13.26 | 3.25 | 3.25 | 0.23 | 0.087 | 0.190 |
| X | 0.028 | 0.25 | 0.31 | 0.009 | 0.0038 | 0.076 | 0.008 | 7.79 | 11.97 | 1.93 | 2.91 | 0.05 | 0.070 | 0.094 |
| Y | 0.031 | 0.34 | 0.75 | 0.013 | 0.0092 | 0.026 | 0.009 | 5.74 | 12.05 | 2.76 | 2.45 | 0.16 | 0.680 | 0.112 |
| Z | 0.038 | 0.38 | 0.88 | 0.018 | 0.0085 | 0.041 | 0.005 | 5.91 | 12.51 | 2.54 | 2.84 | 0.15 | 0.068 | 0.215 |
| AA | 0.021 | 0.22 | 0.94 | 0.015 | 0.0095 | 0.035 | 0.004 | 3.21 | 13.68 | 0.63 | 2.36 | 0.21 | 0.056 | 0.186 |
| AB | 0.016 | 0.19 | 0.83 | 0.022 | 0.0039 | 0.029 | 0.009 | 5.95 | 12.22 | 1.87 | 2.80 | 0.14 | 0.110 | 0.084 |
| AC | 0.030 | 0.34 | 0.84 | 0.010 | 0.0075 | 0.021 | 0.008 | 6.01 | 12.84 | 2.03 | 3.01 | 0.02 | 0.098 | 0.092 |
| AD | 0.016 | 0.25 | 0.74 | 0.013 | 0.0009 | 0.048 | 0.008 | 5.35 | 12.64 | 2.59 | 3.44 | 0.17 | 0.065 | 0.101 |
| AE | 0.009 | 0.27 | 0.43 | 0.017 | 0.0045 | 0.021 | 0.015 | 5.41 | 12.18 | 2.45 | 2.23 | 0.20 | 0.078 | 0.168 |
| AF | 0.010 | 0.47 | 0.64 | 0.028 | 0.0010 | 0.043 | 0.007 | 5.54 | 13.45 | 1.96 | 2.57 | 0.22 | 0.055 | 0.253 |
| AG | 0.009 | 0.60 | 0.51 | 0.030 | 0.0074 | 0.081 | 0.012 | 5.19 | 11.99 | 2.05 | 2.89 | 0.06 | 0.069 | 0.154 |
| AH | 0.012 | 0.41 | 0.43 | 0.009 | 0.0083 | 0.068 | 0.005 | 4.01 | 14.01 | 1.15 | 2.47 | 0.13 | 0.088 | 0.133 |
| AI | 0.014 | 0.25 | 0.87 | 0.023 | 0.0028 | 0.037 | 0.007 | 7.45 | 13.11 | 2.44 | 2.25 | 0.02 | 0.120 | 0.291 |
| AJ | 0.008 | 0.41 | 0.48 | 0.024 | 0.0026 | 0.071 | 0.011 | 5.11 | 12.79 | 2.15 | 2.88 | 0.21 | 0.131 | 0.222 |
| AK | 0.026 | 0.43 | 0.95 | 0.017 | 0.0084 | 0.063 | 0.009 | 4.73 | 12.05 | 3.19 | 3.26 | 0.20 | 0.074 | 0.168 |
| AL | 0.017 | 0.20 | 0.66 | 0.018 | 0.0026 | 0.032 | 0.008 | 6.11 | 12.50 | 0.98 | 2.86 | 0.09 | 0.071 | 0.310 |
| AM | 0.028 | 0.25 | 0.31 | 0.009 | 0.0038 | 0.076 | 0.008 | 7.79 | 11.97 | 1.93 | 2.91 | 0.05 | 0.070 | 0.094 |
| AN | 0.031 | 0.34 | 0.75 | 0.013 | 0.0092 | 0.026 | 0.009 | 5.74 | 12.05 | 2.76 | 2.45 | 0.16 | 0.680 | 0.112 |
| AO | 0.010 | 0.21 | 0.40 | 0.021 | 0.0009 | 0.065 | 0.010 | 5.77 | 12.70 | 2.11 | 3.33 | — | 0.066 | 0.091 |
| AP | 0.018 | 0.37 | 0.61 | 0.014 | 0.0032 | 0.017 | 0.009 | 5.41 | 13.70 | 0.93 | 1.94 | 0.28 | 0.052 | 0.128 |
| AQ | 0.010 | 0.30 | 0.38 | 0.028 | 0.0034 | 0.027 | 0.011 | 5.12 | 11.88 | 2.13 | 3.31 | 0.04 | 0.105 | 0.380 |
| AR | 0.024 | 0.28 | 0.46 | 0.030 | 0.0069 | 0.042 | 0.008 | 5.01 | 12.10 | 2.67 | 2.56 | 0.10 | 0.096 | — |

| Steel | Chemical composition (in mass %, balance being Fe and impurities) | | | | | | | | | | | |
|---|---|---|---|---|---|---|---|---|---|---|---|---|
| | Ca | Mg | B | REM | Nb | Ta | Ti | Zr | Hf | Sn | F1 | F2 |
| W | 0.0041 | — | — | — | — | — | — | — | — | — | 0.0410 | 0.393 |
| X | — | 0.0180 | — | — | — | — | — | — | — | — | 0.1800 | 0.196 |
| Y | — | — | 0.0170 | — | 0.051 | — | — | — | — | — | 0.0340 | 0.283 |
| Z | — | — | — | 0.090 | — | — | — | — | — | — | 0.0900 | 0.292 |
| AA | 0.0061 | — | — | — | — | 0.082 | — | — | — | — | 0.0610 | 0.328 |
| AB | — | 0.0210 | — | — | — | — | 0.086 | — | — | — | 0.2100 | 0.280 |
| AC | — | — | 0.0140 | — | — | — | — | 0.009 | — | — | 0.0280 | 0.171 |
| AD | — | — | — | 0.180 | — | — | — | — | 0.083 | — | 0.1800 | 0.342 |
| AE | 0.0030 | — | 0.0080 | — | — | — | — | — | — | 0.021 | 0.0460 | 0.312 |
| AF | 0.0056 | — | — | — | — | — | — | — | — | — | 0.0560 | 0.349 |
| AG | — | 0.0190 | — | — | — | — | — | — | — | — | 0.1900 | 0.205 |
| AH | — | — | 0.0140 | — | — | — | — | — | — | — | 0.0280 | 0.254 |
| AI | — | — | — | 0.130 | 0.021 | — | — | — | — | — | 0.1300 | 0.133 |
| AJ | 0.0046 | — | — | 0.200 | 0.002 | 0.009 | — | — | — | — | 0.2460 | 0.354 |
| AK | 0.0039 | 0.0210 | — | — | 0.047 | — | 0.061 | — | — | — | 0.2490 | 0.363 |
| AL | 0.0071 | — | — | 0.030 | — | 0.017 | 0.053 | — | — | — | 0.1010 | 0.233 |
| AM | — | 0.0180 | — | — | — | — | — | — | — | — | 0.1800 | 0.196 |
| AN | — | — | 0.0170 | — | 0.051 | — | — | — | — | — | 0.0340 | 0.283 |
| AO | — | 0.0160 | — | — | — | — | — | — | — | — | 0.1600 | 0.167 |
| AP | — | — | 0.0080 | — | — | — | — | — | — | — | 0.0160 | 0.377 |
| AQ | — | — | — | — | — | — | 0.024 | — | — | — | 0.0000 | 0.206 |
| AR | — | — | 0.0190 | 0.028 | — | 0.037 | — | — | 0.035 | — | 0.0660 | 0.228 |

Note that the symbol "–" in Table 3 means that the content of the corresponding element was at an impurity level. For example, it means that the respective contents of Ca, Mg, and B of steel Z were 0% when rounded off to four decimal places. For example, it means that the respective contents of REM, Nb, Ta, Ti, Zr, Hf, and Sn of steel W were 0% when rounded off to three decimal places. Further, F1 that was obtained based on the chemical composition described in Table 3 and the definition described above is shown in Table 3. In addition, F2 that was obtained based on the chemical composition described in Table 3 and the definition described above is shown in Table 3.

Ingots of Test Numbers 45 to 88 were heated at 1250° C. for three hours, and then subjected to hot forging to produce round billets having a diameter of 200 mm. The round billets of Test Numbers 45 to 88 after hot forging were held at 1230° C. for 120 minutes, and then subjected to piercing-rolling by a test piercing machine. The area reduction ratio during the piercing-rolling was 65%. In this way, hollow shells having an outer diameter of 139.7 mm and a wall thickness of 12.09 mm were produced.

The hollow shells of Test Numbers 45 to 88 were subjected to quenching. The quenching was performed by reheating each hollow shell in a heat treatment furnace, and then immersing the hollow shell in a water bath. For the hollow shells of Test Numbers 45 to 88, the quenching temperature (furnace temperature of heat treatment furnace) was 900° C., and the time for which each hollow shell was held at the quenching temperature was 60 minutes. The hollow shells of Test Numbers 45 to 88 after quenching were subjected to tempering. The tempering was performed by reheating each hollow shell after quenching in a tempering furnace, and holding the hollow shell at the tempering temperature. For Test Numbers 45 to 88, the tempering temperature and tempering time employed for the tempering are shown in Table 4. Seamless pipes of Test Numbers 45 to 88 were produced by the foregoing production process.

TABLE 4

| Test No. | Steel | F2 | Tempering temperature (° C.) | Tempering time (min) | Yield strength (MPa) | Inner surface flaw maximum depth (mm) | Hot tensile strength (MPa) | Corrosion resistance test |
|---|---|---|---|---|---|---|---|---|
| 45 | W | 0.393 | 610 | 10 | 856 | 0.0 | 128 | E |
| 46 | X | 0.196 | 630 | 10 | 801 | 0.2 | 114 | E |
| 47 | Y | 0.283 | 590 | 20 | 823 | 0.1 | 124 | E |
| 48 | Z | 0.292 | 580 | 20 | 832 | 0.1 | 121 | E |
| 49 | AA | 0.328 | 610 | 10 | 764 | 0.0 | 126 | E |
| 50 | AB | 0.280 | 620 | 20 | 796 | 0.1 | 122 | E |
| 51 | AC | 0.171 | 620 | 20 | 816 | 0.2 | 109 | E |
| 52 | AD | 0.342 | 590 | 30 | 853 | 0.0 | 120 | E |
| 53 | AE | 0.312 | 620 | 20 | 846 | 0.0 | 122 | E |
| 54 | AF | 0.349 | 600 | 10 | 795 | 0.0 | 128 | E |
| 55 | AG | 0.205 | 600 | 20 | 772 | 0.1 | 115 | E |
| 56 | AH | 0.254 | 620 | 10 | 774 | 0.1 | 119 | E |
| 57 | AI | 0.133 | 600 | 30 | 800 | 0.2 | 109 | E |
| 58 | AJ | 0.354 | 590 | 20 | 816 | 0.0 | 124 | E |
| 59 | AK | 0.363 | 600 | 10 | 858 | 0.0 | 125 | E |
| 60 | AL | 0.233 | 630 | 10 | 780 | 0.1 | 117 | E |
| 61 | AM | 0.196 | 620 | 20 | 663 | 0.2 | 109 | E |
| 62 | AN | 0.283 | 600 | 30 | 689 | 0.1 | 111 | E |
| 63 | AO | 0.167 | 610 | 30 | 835 | 0.3 | 107 | E |
| 64 | AP | 0.377 | 600 | 20 | 767 | 0.0 | 135 | E |
| 65 | AQ | 0.206 | 630 | 10 | 856 | 0.3 | 120 | E |
| 66 | AR | 0.228 | 580 | 30 | 825 | 0.1 | 116 | NA |
| 67 | W | 0.393 | 560 | 80 | 893 | 0.0 | 128 | E |
| 68 | X | 0.196 | 530 | 90 | 920 | 0.2 | 114 | E |
| 69 | Y | 0.283 | 540 | 70 | 882 | 0.1 | 124 | E |
| 70 | Z | 0.292 | 550 | 80 | 864 | 0.1 | 121 | E |
| 71 | AA | 0.328 | 560 | 70 | 893 | 0.0 | 126 | E |
| 72 | AB | 0.280 | 520 | 90 | 930 | 0.1 | 122 | E |
| 73 | AC | 0.171 | 510 | 80 | 964 | 0.2 | 109 | E |
| 74 | AD | 0.342 | 530 | 70 | 912 | 0.0 | 120 | E |
| 75 | AE | 0.312 | 570 | 80 | 886 | 0.0 | 122 | E |
| 76 | AF | 0.349 | 560 | 100 | 873 | 0.0 | 128 | E |
| 77 | AG | 0.205 | 510 | 100 | 942 | 0.1 | 115 | E |
| 78 | AH | 0.254 | 520 | 70 | 921 | 0.1 | 119 | E |
| 79 | AI | 0.133 | 520 | 60 | 890 | 0.2 | 109 | E |
| 80 | AJ | 0.354 | 550 | 70 | 867 | 0.0 | 124 | E |
| 81 | AK | 0.363 | 560 | 80 | 870 | 0.0 | 125 | E |
| 82 | AL | 0.233 | 510 | 60 | 958 | 0.1 | 117 | E |
| 83 | AM | 0.196 | 520 | 70 | 940 | 0.2 | 109 | E |
| 84 | AN | 0.283 | 530 | 90 | 869 | 0.1 | 111 | E |
| 85 | AO | 0.167 | 540 | 80 | 926 | 0.3 | 107 | E |
| 86 | AP | 0.377 | 530 | 80 | 936 | 0.0 | 135 | E |
| 87 | AQ | 0.206 | 560 | 100 | 899 | 0.3 | 120 | E |
| 88 | AR | 0.228 | 530 | 90 | 923 | 0.1 | 116 | NA |

[Evaluation Tests]

The produced seamless pipes of Test Numbers 45 to 88 were subjected to a tensile test, a test to measure the maximum depth of an inner surface flaw, a hot tensile strength measurement test, and a corrosion resistance test.

[Tensile Test]

The seamless pipes of Test Numbers 45 to 88 were subjected to a tensile test in the same manner as in Example 1. The 0.2% offset proof stress obtained in the tensile test performed by the method described above was adopted as the yield strength (MPa). For Test Numbers 45 to 88, the obtained yield strength (MPa) is shown in Table 4.

[Test to Measure Maximum Depth of Inner Surface Flaw]

The seamless pipes of Test Numbers 45 to 88 were subjected to a test to measure the maximum depth of an inner surface flaw in the same manner as in Example 1. The maximum value of the depth of the inner surface flaw that was determined by the method described above was defined as the maximum depth (mm) of the inner surface flaw. The maximum depth (mm) of the inner surface flaw obtained for each of Test Numbers 45 to 88 is shown in Table 4.

[Hot Tensile Strength Measurement Test]

The seamless pipes of Test Numbers 45 to 88 were subjected to a hot tensile strength measurement test in the same manner as in Example 1. The maximum stress (MPa) until the round bar specimen broke that was determined by the method described above was defined as "hot tensile strength". The hot tensile strength (MPa) obtained for each of Test Numbers 45 to 88 is shown in Table 4.

[Corrosion Resistance Test]

The seamless pipes of Test Numbers 45 to 88 were subjected to a corrosion resistance test in the same manner as in Example 1. A four-point bending test was conducted by the method described above, and after being held for 720 hours, each test specimen was observed with the naked eye. Test specimens in which cracking was not confirmed as the result of the observation were determined as being "E" (Excellent). On the other hand, test specimens in which cracking was confirmed were determined as being "NA" (Not Acceptable). The evaluation results obtained for Test Numbers 45 to 88 are shown in Table 4.

[Test Results]

Referring to Table 3 and Table 4, in the seamless pipes of Test Numbers 45 to 62, 64, 67 to 84, and 86, the chemical composition was appropriate and F1 was 0.0010 or more. In addition, in these seamless pipes, the yield strength was 655 MPa or more. As a result, the maximum depth of an inner surface flaw was less than 0.3 mm, and thus the formation of an inner surface flaw had been suppressed. In addition, the evaluation obtained in the corrosion resistance test was "E", which indicated the excellent corrosion resistance.

In the seamless pipes of Test Numbers 45 to 62 and 67 to 84, furthermore, the W content was 0.01 to 0.25%. As a result, the hot tensile strength was 130 MPa or less, and thus a load applied to the piercing-rolling mill was reduced.

In addition, in the seamless pipes of Test Numbers 45, 47 to 50, 52 to 56, 58 to 60, 62, 64, 67, 69 to 72, 74 to 78, 80 to 82, 84, and 86, F2 was 0.200 or more. As a result, the maximum depth of an inner surface flaw was 0.1 mm or less, and thus formation of an inner surface flaw had been further suppressed.

On the other hand, in the seamless pipes of Test Numbers 63 and 85, the W content was too low. As a result, the maximum depth of an inner surface flaw was 0.3 mm or more, and formation of an inner surface flaw had not been suppressed.

The seamless pipes of Test Numbers 65 and 87 did not contain any of Ca, Mg, B, and REM, and thus F1 was less than 0.0010. As a result, the maximum depth of an inner surface flaw was 0.3 mm or more, and formation of an inner surface flaw had not been suppressed.

The seamless pipes of Test Numbers 66 and 88 did not contain Co. As a result, the evaluation in the corrosion resistance test was "NA", and thus the excellent corrosion resistance was not exhibited.

So far, an embodiment of the present disclosure has been described. However, the embodiment described above is merely an example for carrying out the present disclosure. Therefore, the present disclosure is not limited to the above-described embodiment, and can be practiced by appropriately modifying the above-described embodiment within a range not departing from the spirit thereof.

INDUSTRIAL APPLICABILITY

The seamless pipe according to the present disclosure is widely applicable to steel materials to be utilized in a severe environment such as a polar region, and preferably can be utilized as a steel material that is utilized in an oil well environment, and further preferably can be utilized as a steel material for casing pipes, tubing pipes, line pipes and the like.

The invention claimed is:

1. A martensitic stainless steel seamless pipe, consisting of, in mass %:

C: 0.001 to 0.050%,
Si: 0.05 to 1.00%,
Mn: 0.05 to 2.00%,
P: 0.030% or less,
S: 0.0100% or less,
Al: 0.005 to 0.100%,
N: 0.020% or less,
Ni: 1.00 to 9.00%,
Cr: 8.00 to 16.00%,
Cu: 1.15% or less,
Mo: 1.00 to 5.00%,
W: 0.01 to 0.25%,
V: 0.010 to 1.500%,
Co: 0.001 to 0.500%,
Ca: 0 to 0.0250%,
Mg: 0 to 0.0250%,
B: 0 to 0.0200%,
rare earth metal: 0 to 0.200%,
Nb: 0 to 0.100%,
Ta: 0 to 0.100%,
Ti: 0 to 0.100%,
Zr: 0 to 0.100%,
Hf: 0 to 0.100%,
Sn: 0 to 0.100%, and
the balance: Fe and impurities, wherein:

within ranges of contents of elements of the martensitic stainless steel seamless pipe, the contents of elements satisfy Formula (1), and a yield strength is 655 MPa or more, and a hot tensile strength of the martensitic stainless steel seamless pipe is 130 MPa or less, the hot tensile strength being a maximum stress until break when tensile stress is applied at 1100° C. after heating to 1250° C. and cooling at a cooling rate of 100° C./min:

$$10Ca+10\ Mg+2B+REM \geq 0.0010 \quad (1)$$

where, a content in mass % of a corresponding element is substituted for Ca, Mg, and B in Formula (1), and a total content in mass % of rare earth metal is substituted for REM in Formula (1).

2. The martensitic stainless steel seamless pipe according to claim 1, containing one or more elements selected from the group consisting of:

Nb: 0.001 to 0.100%,
Ta: 0.001 to 0.100%,
Ti: 0.001 to 0.100%,
Zr: 0.001 to 0.100%,
Hf: 0.001 to 0.100%, and
Sn: 0.001 to 0.100%.

3. The martensitic stainless steel seamless pipe according to claim 1, wherein:

within the ranges of contents of elements of the martensitic stainless steel seamless pipe, the contents of elements satisfy Formula (2), $$0.05Mo+W \geq \alpha \quad (2)$$

where, $\alpha$ in Formula (2) is 0.240 in a case where, among the elements of the martensitic stainless steel seamless pipe, a Cu content is less than 0.50%, and is 0.200 in a case where the Cu content is 0.50 to 3.50%; and a content in mass % of a corresponding element is substituted for W and Mo in Formula (2).

4. The martensitic stainless steel seamless pipe according to claim 2, wherein:

within the ranges of contents of elements of the martensitic stainless steel seamless pipe, the contents of elements satisfy Formula (2), $$0.05Mo+W \geq \alpha \quad (2)$$

where, $\alpha$ in Formula (2) is 0.240 in a case where, among the elements of the martensitic stainless steel seamless pipe, a Cu content is less than 0.50%, and is 0.200 in a case where the Cu content is 0.50 to 3.50%; and a content in mass % of a corresponding element is substituted for W and Mo in Formula (2).

5. The martensitic stainless steel seamless pipe according to claim 1, wherein:

the martensitic stainless steel seamless pipe is a seamless pipe for oil wells.

6. The martensitic stainless steel seamless pipe according to claim 2, wherein:

the martensitic stainless steel seamless pipe is a seamless pipe for oil wells.

7. The martensitic stainless steel seamless pipe according to claim 3, wherein:

the martensitic stainless steel seamless pipe is a seamless pipe for oil wells.

8. The martensitic stainless steel seamless pipe according to claim 4, wherein:

the martensitic stainless steel seamless pipe is a seamless pipe for oil wells.

* * * * *